US006913350B2

(12) United States Patent
Kobayashi et al.

(10) Patent No.: US 6,913,350 B2
(45) Date of Patent: Jul. 5, 2005

(54) INK-JET RECORDING APPARATUS

(75) Inventors: Atsushi Kobayashi, Nagano (JP); Hitotoshi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/805,254

(22) Filed: Mar. 22, 2004

(65) Prior Publication Data

US 2004/0174417 A1 Sep. 9, 2004

Related U.S. Application Data

(62) Division of application No. 09/765,348, filed on Jan. 22, 2001, now Pat. No. 6,733,114.

(30) Foreign Application Priority Data

| | | |
|---|---|---|
| Jan. 21, 2000 | (JP) | P.2000-012460 |
| Feb. 1, 2000 | (JP) | P.2000-024417 |
| Feb. 1, 2000 | (JP) | P.2000-024421 |
| Mar. 14, 2000 | (JP) | P.2000-069692 |
| Jun. 23, 2000 | (JP) | P.2000-189520 |

(51) Int. Cl.[7] ..... B41J 2/175
(52) U.S. Cl. ..... 347/85
(58) Field of Search ..... 347/85, 86, 87, 347/7, 49

(56) References Cited

U.S. PATENT DOCUMENTS

| | | | | |
|---|---|---|---|---|
| 4,558,326 | A | * 12/1985 | Kimura et al. | 347/30 |
| 4,620,835 | A | 11/1986 | Bell | |
| 5,465,772 | A | 11/1995 | Sartor | |
| 5,704,403 | A | 1/1998 | Schwenk et al. | |
| 5,729,256 | A | 3/1998 | Yamanaka et al. | |
| 5,910,810 | A | 6/1999 | Brooks et al. | |
| 5,912,688 | A | 6/1999 | Gragg | |
| 5,980,031 | A | 11/1999 | Sasaki et al. | |
| 6,010,210 | A | 1/2000 | Wilson et al. | |
| 6,220,699 | B1 | * 4/2001 | Taylor et al. | 347/85 |
| 6,224,198 | B1 | * 5/2001 | Cook et al. | 347/85 |
| 6,296,353 | B1 | * 10/2001 | Thielman et al. | 347/86 |

FOREIGN PATENT DOCUMENTS

| | | |
|---|---|---|
| EP | 0 778 145 | 6/1997 |
| EP | 0 803 362 | 10/1997 |
| EP | 0 803 364 | 10/1997 |
| EP | 0 838 339 | 4/1998 |
| EP | 0 857 576 | 8/1998 |
| EP | 0 927 638 | 7/1999 |
| EP | 0 940 260 | 9/1999 |
| EP | 0 947 328 | 10/1999 |
| EP | 0 965 451 | 12/1999 |
| JP | 05 318760 | 3/1993 |

OTHER PUBLICATIONS

Japanese Abstract No. 10 1385056, dated May 26, 1998.
Japanese Abstract No. 61229564, dated Oct. 13, 1986.
Japanese Abstract No. 07012669, dated Jan. 17, 1995.

* cited by examiner

*Primary Examiner*—K. Feggins
(74) *Attorney, Agent, or Firm*—Sughrue Mion, PLLC

(57) ABSTRACT

An ink jet recording apparatus wherein a sub-tank mounted on a carriage is replenished with ink from an ink cartridge as a main tank by the action of pressurized air from an air pressurizing pump. The ink jet recording apparatus is provided with means for opening an air flow passage from the air pressurizing pump to the ink cartridge into the atmosphere as a cover member of a cartridge holder is opened when the ink cartridge is attached or detached. The recording apparatus has an on-off valve unit for maintaining pressure on the air flow passage in a predetermined range and drive means capable of forcibly opening the on-off valve unit for releasing a pressurization state, for example, when the operation power of the recording apparatus stops. The recording apparatus further includes a diaphragm displaced upon reception of air pressure on the air flow passage and output generation means for generating a control signal based on the displacement amount of the diaphragm, and driving the air pressurizing pump is controlled by the control signal generated by the output generation means.

17 Claims, 20 Drawing Sheets

INK-JET RECORDING APPARATUS

This is a divisional of applicaction Ser. No. 09/765,348 filed Jan. 22, 2001 now U.S. Pat. No. 6,733,114; the disclosure of which is incorporated herein by reference.

BACKGROUND OF THE INVENTION

1. Field of the Invention

This invention relates to an ink jet recording apparatus, and in particular to an ink jet recording apparatus wherein pressurized air generated by an air pressurizing pump is applied to a main tank serving as an ink cartridge storing ink, and a record head mounted on a carriage is replenished with ink from the main tank by the action of the pressurized air.

2. Description of the Related Art

An ink-jet recording apparatus produces comparatively low noise during printing operation and can form small dots at high density. Hence, the ink-jet recording apparatus has recently been used in a number of printing applications, including color printing.

Such an ink-jet recording apparatus is usually equipped with an ink-jet recording head which is mounted on a carriage and moved in the widthwise direction of recording paper, and paper feed means for moving the recording paper in the direction orthogonal to the traveling direction of the recording head. On the basis of print data, ink droplets are ejected from the recording head, thus recording the data on the recording paper.

The recording head is mounted on the carriage, and is capable of ejecting ink droplets of, for example, black, yellow, cyan, and magenta. Accordingly, the ink-jet recording apparatus enables full-color printing by changing the proportions of ink types, as well as effecting text printing with black ink.

Incidentally, in order to effect a comparatively-high volume of printing, a recording apparatus of this type supplied for, for example, an office or business purpose, requires use of high-volume ink cartridges. To this end, there has been provided a recording apparatus, in which main tanks serving as ink cartridges are fitted to a cartridge holder provided, for example, to an apparatus main body.

In the recording apparatus, sub-tanks are disposed on the carriage having the recording head, and the respective sub-tanks are replenished with ink from corresponding main tanks by way of ink supply tubes. The sub-tanks, in turn, supply ink to the recording head.

Recently, growing demand exists for a large-size recording apparatus capable of effecting printing on larger-size paper, in which a carriage travels a longer scan distance. In order to improve throughput of such a recording apparatus, a larger number of nozzles are provided in a recording head.

Further, demand exists for a recording apparatus which sequentially supplies ink to the respective sub-tanks mounted on the carriage from corresponding main tanks while performing printing operation, in order to improve throughput, and which stably supplies ink from the respective sub-tanks to the recording head.

In such a recording apparatus, since the ink supply tubes must be proved for connection between the main tanks and the sub-tanks on the carriage to correspond to the types of ink, and since the carriage travels over a longer scan distance, the lengths of respective ink supply tubes inevitably increase.

Further, as mentioned above, a larger number of nozzles are provided in the recording head. Hence, such a recording apparatus encounters a technical problem of deficient ink supply to the sub-tanks because the recording head consumes a large quantity of ink, and an increase in the dynamic pressure (i.e., pressure loss) of ink is likely to occur within each of the ink supply tubes interconnecting the ink cartridges and the sub-tanks.

As one measure to prevent this technical problem, there may be employed, for example, a construction in which air pressure is applied to the main tanks to forcibly inducing ink flows from the main tanks to the sub-tanks under air pressure.

An ink jet recording apparatus constructed as descried above involves the following several problems to be solved:

First, in the construction for pressurizing the main tank, an air pressurizing pump is necessary for applying pressurized air to the main tank. A pressure regulating function capable of constantly applying stable air pressure to the main tank is required.

Second, an atmosphere release function is required for releasing the air pressure from the main tank during non-operated state in which power for the recording head is turned off, in order to eliminate, for example, a problem of inducing ink leakage from the main tank.

Third, in the construction for pressurizing the main tank, the air pressurizing pump should be driven all the time when power for the recording apparatus is turned on, in order to stably apply the pressurized air to the main tank and to assure proper operation of the ink supply system of this type.

However, in a case where the air pressurizing pump is driven all the time, there arise problems of noise produced by the air pressurizing pump, and durability of the air pressurizing pump. Therefore, another problem of cost increase associated with a countermeasure for these problems is also encountered.

Accordingly, a preferable approach required is to intermittently drive the pressurizing pump so that in the air pressure for each main tank is appropriately maintained within a tolerable range.

Fourth, a pressure detector is required for detecting air pressure given to each main tank. In this case, the following control can be adopted: If the air pressure detected by the pressure detector is equal to or less than a predetermined pressure value, the pressurizing pump is driven, and if the air pressure exceeds the predetermined pressure value, driving the pressurizing pump is stopped.

However, this control causes the following operation. That is, for example, as ink in the main tank is consumed even slightly based on the print operation, etc., the pressure detector detects a pressure value equal to or less than the predetermined value and the pressurizing pump is driven, and as the pressurizing pump is driven for a short period, the pressure detector detects a pressure value exceeding the predetermined value and the driving of the pressurizing pump is stopped.

This operation, in which the pressurizing pump is intermittently driven and stopped, is repeated thus repeated at extremely short time intervals. Therefore, a user may have a doubt that the recording apparatus malfunctions.

Fifth, a simple application of the above-mentioned construction causes another problem. Since pressurized air is applied to the ink cartridge forming the main tank detachably mounted to a cartridge holder, a careless removal of the ink cartridge from the cartridge holder causes ink to gush or splash out by the action of the pressurized air, thereby soiling the surrounding areas.

Since an outer shell member forming the ink cartridge receives the action of the pressurized air and is expanded in some degree, it is difficult to remove the ink cartridge from the cartridge holder. If the ink cartridge is removed forcibly, both the ink cartridge and the cartridge holder, particularly, an ink replenishment connection plug, etc., to which both the ink cartridge and the cartridge holder are connected, are deformed, causing damage to both the ink cartridge and the cartridge holder.

The sixth problem is as follows: Ink supplied from the main tank to the sub-tank in the ink jet recording apparatus of the above construction has a temperature depending property in which viscosity of ink is changed depending on environmental temperature; the viscosity is high at low temperature and is lowered as the temperature is increased.

Therefore, the velocity of ink replenishment flow from the main tank to the sub-tank has such a temperature depending property that the velocity is higher as the temperature is higher.

In the recording apparatus adopting the configuration wherein the sub-tank is replenished with ink from the main tank as described above, it is desired that the ink replenishment flow velocity from the main tank to the sub-tank should fall within a given range independently of the environmental temperature.

In this case, to suppress change in the ink replenishment flow velocity caused by change in the environmental temperature within a predetermined range, a control system is required to change the setup pressure of the pressurized air applied to the main tank in response to the temperature change.

SUMMARY OF THE INVENTION

It is therefore a first object of the invention to provide an ink jet recording apparatus adopting a configuration wherein pressurized air is applied to an ink cartridge forming a main tank for sending ink to a sub-tank and an ink jet recording apparatus comprising an air pressuring pump for applying pressurized air to the main tank to provide a pressure regulating function capable of always applying stable air pressure to the main tank.

It is a second object of the invention to provide an ink jet recording apparatus comprising an atmosphere release function capable of forcibly air pressure applied to a main tank while using a pressure regulating function capable of managing the air pressure applied to the main tank in a given range and further provide an on-off valve unit which serves as both the pressure regulating function and the atmosphere release function and can be adopted preferably for this kind of ink jet recording apparatus.

It is a third object of the invention to provide an ink jet recording apparatus wherein air pressure applied from a pressurizing pump to a main tank is detected and driving the pressurizing pump can be controlled by a control signal based on the pressure detection value for always managing the air pressure applied to the main tank in an appropriate range.

It is a fourth object of the invention to provide an ink jet recording apparatus wherein the air pressure applied to a main tank can always be managed in an appropriate range while the frequent drive operation of a pressurizing pump is suppressed.

It is a fifth object of the invention to provide an ink jet recording apparatus adopting a configuration wherein pressurized air is applied to an ink cartridge forming a main tank for sending ink to a sub-tank, wherein when the ink cartridge is drawn out from a cartridge holder, the problem of ink leakage, etc., caused by the action of the pressurized air as mentioned above can be circumvented.

It is a sixth object of the invention to provide an ink jet recording apparatus comprising a pressure detector provided with a function capable of maintaining the change amount of the flow velocity of ink sent out from a main tank in a predetermined range if the environmental temperature is changed.

To accomplish the first object of the invention, according to a first aspect of the invention, there is provided an ink jet recording apparatus comprising a record head being mounted on a carriage and reciprocated in a width direction of record paper and a sub-tank being mounted on the carriage together with the record head for receiving replenishment with ink via an ink replenishment passage from an ink cartridge forming a main tank and supplying ink to the record head, wherein air pressure generated by an air pressurizing pump is applied to the ink cartridge and the sub-tank is replenished with.ink.from the ink cartridge by the action of the air pressure, wherein a pressure regulation valve being opened upon reception of a predetermined or more air pressure for maintaining the air pressure in a predetermined range and a pressure detector for receiving the air pressure and detecting a pressure state are placed on an air flow passage from the air pressurizing pump to the ink cartridge and driving the air pressurizing pump is controlled based on output of the pressure detector.

Next, according to a second aspect of the invention, there is provided an ink jet recording apparatus comprising a record head being mounted on a carriage and reciprocated in a width direction of record paper and a sub-tank being mounted on the carriage together with the record head for receiving replenishment with ink via an ink replenishment passage from a main tank and supplying ink to the record head, wherein air pressure generated by an air pressurizing pump is applied to the main tank and the sub-tank is replenished with ink from the main tank by the action of the air pressure, and having an on-off valve unit comprising a valve member being placed on an air flow passage from the air pressurizing pump to the main tank and opened under a given or more air pressure for maintaining the air pressure in the air flow passage in a predetermined range and drive means capable of forcibly opening the valve member in the on-off valve unit, thereby releasing the pressurization state of the air pressurizing pump.

In this case, the ink replenishment passage from the main tank to the sub-tank preferably is implemented as a flexible ink replenishment tube.

Preferably, an ink replenishment valve is placed on the ink replenishment passage between the main tank and the sub-tank and is opened or closed by a control signal generated by ink amount detection means for detecting the amount of ink in the sub-tank.

It is desirable that the main tank should have an outer shell formed in a hermetic state and store an ink pack formed of a flexible material in which ink is sealed and that the air pressure generated by the air pressurizing pump should be applied to space formed by an outer shell component of the ink cartridge and the ink pack.

Further, it is desirable that a plurality of main tanks for sealing inks ejected through the record head should be provided and that air pressure generated by one air pressurizing pump should be applied each of the main tanks.

In a preferred embodiment of the ink jet recording apparatus according to the second aspect of the invention described above, a drive shaft capable of moving the valve member is placed in the on-off valve unit and is driven by the drive means, whereby the valve member is opened.

In a preferred embodiment, the drive force of the drive means is transmitted to a drive lever rotated via a support shaft and is transmitted via the drive lever to the drive shaft in the on-off valve unit. An electromagnetic plunger can be adopted preferably as the drive means.

In this case, preferably the valve member in the on-off valve unit is opened by the drive force of the electromagnetic plunger generated when the electromagnetic plunger is energized, thereby releasing the pressurization state.

Further, in a preferred embodiment, the drive force of the electromagnetic plunger acts on one end part of a drive lever rotated via a support shaft, a spring member for urging in an opposite direction to the rotation direction of the drive lever in the drive state of the electromagnetic plunger is placed at an opposite end part of the drive lever, and a drive shaft in the on-off valve unit is joined between the one end part of the drive lever and the support shaft and opens the valve member in the on-off valve unit by the urging force of the spring member when the electromagnetic plunger is non-energized, thereby releasing the pressurization state.

On the other hand, a ventilation hole for communicating with the atmosphere can be made in the on-off valve unit and be closed by the elastic force of the valve member for maintaining a closed valve state.

The on-off valve unit can also be formed with a ventilation hole for communicating with the atmosphere and comprise a spring member for urging the valve member toward the ventilation hole and the ventilation hole can also be closed by the urging force of the spring member for maintaining a closed valve state.

Further, the on-off valve unit may be formed with a ventilation hole for communicating with the atmosphere and comprise a spring member for urging the valve member toward the ventilation hole and the ventilation hole may be closed by the elastic force of the valve member and the urging force of the spring member for maintaining a closed valve state. In this case, a diaphragm valve can be adopted preferably as the valve member.

In a preferred embodiment, the diaphragm valve has a peripheral portion clamped in a joint part of an upper case and a lower case forming an outer shell of the on-off valve unit, either of the upper and lower cases and the diaphragm valve form an air chamber in a hermetic state, and the diaphragm valve opens or closes a ventilation hole made so as to communicate with the air chamber.

According to the ink jet recording apparatus according to the second aspect of the invention, air pressure generated by the pressuring pump is applied to the main tank, so that the sub-tank can be replenished with necessary and sufficient ink from the main tank.

The on-off valve unit is placed on the air flow passage from the pressurizing pump to the main tank and the valve member installed in the on-off valve unit serves as both the pressure regulating function of opening the valve under the predetermined air pressure or more and the atmosphere release function of forcibly opening the valve upon reception of the drive force of the drive means.

Therefore, the air pressure in the appropriate range is always applied to each main tank by the pressure regulating function during the operation of the recording apparatus, whereby each sub-tank can be stably replenished with ink from each main tank.

The atmosphere release function can be used to release the air pressure to the main tank, for example, in the pause mode in which operation power supply is not input to the recording apparatus, thereby making it possible to circumvent the problem of inducing ink leakage from the main tank in the pause mode of the recording apparatus.

Further, the valve member in the on-off valve unit serves as both the pressure regulating function and the atmosphere release function, so that the occupation volume in the recording apparatus can be lessened and in addition, the product costs can be decreased as compared with the configuration wherein the pressure regulating function and the atmosphere release function are provided separately.

Next, according to a third aspect of the invention, there is provided an ink jet recording apparatus wherein pressurized air generated by an air pressurizing pump is applied to a main tank storing ink and a record head mounted on a carriage is replenished with ink from the main tank by the action of the pressurized air, wherein a pressure detector for detecting pressure of the pressurized air is placed on an air flow passage between the air pressurizing pump and the main tank and driving the air pressurizing pump is controlled based on a control signal generated according to the pressure detected by the pressure detector, the pressure detector comprising a diaphragm being displaced upon reception of the air pressure of the pressurized air and output generation means for generating a control signal based on the displacement amount of the diaphragm.

In this case, preferably the main tank has an outer shell formed in a hermetic state and stores an ink pack formed of a flexible material in which ink is sealed and wherein the pressurized air generated by the air pressurizing pump is applied to a pressure chamber formed by an outer shell component of the main tank and the ink pack.

Preferably, a sub-tank mounted on the carriage is replenished with ink via an ink replenishment passage from the main tank and ink is supplied from the sub-tank to the record head mounted on the carriage.

In addition, it is desirable that the ink replenishment passage from the main tank to the sub-tank should be implemented as a flexible ink replenishment tube.

In a preferred embodiment of the ink jet recording apparatus according to the third aspect of the invention described above, the output generation means comprises a moving member made to advance or retreat by replacement of the diaphragm and a photosensor made up of a light source and a light receiving element placed so as to cross a move path of the moving member and generates the control signal based on output of the light receiving element forming a part of the photosensor.

In another preferred embodiment, the output generation means comprises a moving member made to advance or retreat by replacement of the diaphragm and a photosensor made up of a light source for projecting light onto a move path of the moving member and a light receiving element for receiving reflected light of the light source based on a move of the moving member and generates the control signal based on output of the light receiving element forming a part of the photosensor.

Although any of the forms of the ink jet recording apparatus described above is adopted, the following configuration can be adopted preferably: The diaphragm is formed of an elastic material and the moving member is made to advance or retreat based on replacement of the diaphragm depending on balance of the air pressure received by the diaphragm and the restoration force of the diaphragm.

In this case, it is desirable that the moving member should be formed with a step part for preventing the diaphragm from being excessively displaced by the air pressure. The following configuration can also be adopted: The ink jet recording apparatus further comprises a spring member for urging in a restoration direction of the diaphragm wherein the moving member is made to advance or retreat based on replacement of the diaphragm depending on balance of the air pressure received by the diaphragm, the restoration force of the diaphragm, and the urging force of the spring member.

It is desirable that the ink jet recording apparatus should further comprise a stopper member for receiving the urging force of the spring member and blocking excessive displacement of the diaphragm.

The moving member can be molded integrally with the diaphragm.

On the other hand, the diaphragm preferably is formed of rubber. The diaphragm may be formed of rubber and a cloth.

Although any of the forms of the ink jet recording apparatus described above is adopted, it is desirable that the diaphragm should be placed so as to close an opening part of a case, whereby a space portion for receiving the air pressure from the air pressurizing pump is formed in the case, and that the case should be formed with a pressurized air introduction connection tube for introducing the pressurized air from the air pressurizing pump into the space portion and a plurality of pressurized air distribution connection tubes for distributing the pressurized air to each main tank from the space portion.

According to the ink jet recording apparatus according to the third aspect of the invention, pressurized air generated by the pressuring pump is applied to the main tank, so that the record head mounted on the carriage can be replenished with a necessary and sufficient amount of ink by the action of the air pressure.

The pressure detector placed on the air flow passage between the air pressurizing pump and the main tank monitors the pressurization state to the main tank and the pressurizing pump is controlled so as to be driven intermittently by the control signal generated by the pressure detector.

In this case, the pressure detector comprises the diaphragm displaced upon reception of the air pressure of the pressurized air and the output generation means generates the control signal for controlling driving the pressurizing pump based on the displacement amount of the diaphragm.

The output generation means comprises the moving member made to advance or retreat by replacement of the diaphragm and the photosensor detects the move state of the moving member, whereby the control signal for controlling driving the pressurizing pump is generated.

Therefore, the pressure detector is formed according to the comparatively simple configuration of the diaphragm and the photosensor and thus can be realized at comparative low costs.

Since the pressurizing pump is intermittently driven by the control signal generated by the pressure detector, it is also made possible to solve problems of occurrence of noise and durability caused by driving the pressurizing pump all the time.

To accomplish the above-mentioned object of the invention, according to a fourth aspect of the invention, there is provided an ink jet recording apparatus wherein pressurized air generated by an air pressurizing pump is applied to a main tank storing ink and ink is supplied from the main tank to a record head mounted on a carriage by the action of the pressurized air, comprising a pressure detector being placed on an air flow passage between the air pressurizing pump and the main tank for detecting pressure of the pressurized air and control means for driving the air pressurizing pump if the pressure detection value provided by the pressure detector does not reach a predetermined pressure value, and stopping driving the air pressurizing pump after the expiration of a predetermined time if the pressure detection value provided by the pressure detector reaches the predetermined pressure value.

In this case, preferably the ink jet recording apparatus further comprises a pressure release valve being opened for regulating pressure if the pressure in the air flow passage between the air pressurizing pump and the main tank is a pressure higher than the predetermined pressure detected by the pressure detector, wherein if the pressure detection value provided by the pressure detector reaches the predetermined pressure value, the control means stops driving the air pressurizing pump after the expiration of the time for the pressure release valve to be opened.

The control means comprising the configuration described above is preferably used with the ink jet recording apparatus wherein a sub-tank mounted on the carriage is replenished with ink via an ink replenishment passage from the main tank and ink is supplied from the sub-tank to the record head mounted on the carriage.

In addition, it is desirable that the ink replenishment passage from the main tank to the sub-tank should be implemented as a flexible ink replenishment tube. In this case, preferably the main tank has an outer shell formed in a hermetic state and stores an ink pack formed of a flexible material in which ink is sealed and the pressurized air generated by the air pressurizing pump is applied to a pressure chamber formed by an outer shell component of the main tank and the ink pack.

The pressure detector in the ink jet recording apparatus having the configuration described above preferably comprises a diaphragm being displaced upon reception of the air pressure of the pressurized air and output generation means for generating a control signal based on the displacement amount of the diaphragm.

In a preferred embodiment, the output generation means comprises a moving member made to advance or retreat by replacement of the diaphragm and a photosensor made up of a light source and a light receiving element placed so as to cross a move path of the moving member and generates the control signal based on output of the light receiving element forming a part of the photosensor.

In another preferred embodiment, the output generation means comprises a moving member made to advance or retreat by replacement of the diaphragm and a photosensor made up of a light source for projecting light onto a move path of the moving member and a light receiving element for receiving reflected light of the light source based on a move of the moving member and generates the control signal based on output of the light receiving element forming a part of the photosensor.

In any forms of the ink jet recording apparatus described above, the following configuration can be adopted: The diaphragm is formed of an elastic material and the moving member is made to advance or retreat based on replacement of the diaphragm depending on balance of the air pressure received by the diaphragm and the restoration force of the diaphragm.

Further, the following configuration can also be adopted effectively: The moving member is formed with a step part for preventing the diaphragm from being excessively displaced by the air pressure.

The following configuration can also be adopted: The ink jet recording apparatus further comprises a spring member for urging in a restoration direction of the diaphragm wherein the moving member is made to advance or retreat based on replacement of the diaphragm depending on balance of the air pressure received by the diaphragm, the restoration force of the diaphragm, and the urging force of the spring member.

In this case, it is desirable that the ink jet recording apparatus should further comprise a stopper member for receiving the urging force of the spring member and blocking excessive displacement of the diaphragm. On the other hand, the diaphragm preferably is formed of rubber. The diaphragm may be formed of rubber and a cloth.

It is desirable that the diaphragm should be placed so as to close an opening part of a case, whereby a space portion for receiving the air pressure from the air pressurizing pump is formed in the case, and that the case should be formed with a pressurized air introduction connection tube for introducing the pressurized air from the air pressurizing pump into the space portion and a plurality of pressurized air distribution connection tubes for distributing the pressurized air to each main tank from the space portion.

According to the ink jet recording apparatus according to the fourth aspect of the invention described above, pressurized air generated by the pressuring pump is applied to the main tank, so that the sub-tank mounted on the carriage can be replenished with a necessary and sufficient amount of ink by the action of the air pressure.

The pressure detector placed on the air flow passage between the air pressurizing pump and the main tank monitors the pressurization state to the main tank and driving the pressurizing pump is controlled by the control signal generated by the pressure detector.

In this case, if the pressure detection value provided by the pressure detector does not reach the predetermined pressure value, the air pressurizing pump is driven. If the pressure detection value provided by the pressure detector reaches the predetermined pressure value, driving the air pressurizing pump is stopped after the expiration of the predetermined time.

In the ink jet recording apparatus according to the fourth aspect of the invention, driving the air pressurizing pump is continued for the predetermined time still after the pressure detector detects the predetermined pressure being reached, so that necessary and sufficient pressurized air is accumulated on the air flow passage from the pressurizing pump to the main tank.

When the accumulated pressurized air falls below the level detected by the pressure detector as ink is consumed, the air pressurizing pump is again driven.

In another preferred form, the ink jet recording apparatus comprises the pressure release valve being opened for regulating pressure if a pressure higher than the predetermined pressure detected by the pressure detector is received if the pressure detection value of the pressure detector reaches the predetermined pressure value, and using the function of the pressure release valve, driving the air pressurizing pump is stopped after the expiration of the time for the pressure release valve to be opened.

According to the form, necessary and sufficient pressurized air is accumulated on the air flow passage from the pressurizing pump to the main tank and in this state, the pressure release valve is opened and a constant pressure is held on the air flow passage from the pressurizing pump to the main tank regardless of driving the pressurizing pump.

When the accumulated pressurized air falls below the level detected by the pressure detector as ink is consumed, the air pressurizing pump is again driven.

In this case, the problem of applying excessive pressure to the main tank can be circumvented by the action of the pressure release valve, and the reliability of the operation of this kind of ink jet recording apparatus can be guaranteed.

Therefore, in any configurations described above, necessary and sufficient pressurized air is accumulated on the air flow passage from the pressurizing pump to the main tank and thus considerable time is required by the time the pressurized air falls below the level detected by the pressure detector and the problem of the frequently repetitive operation of driving and stopping the pressurizing pump can be solved.

To accomplish the fifth object of the invention, according to a fifth aspect of the invention, there is provided an ink jet recording apparatus comprising a record head being mounted on a carriage and reciprocated in a width direction of record paper and a sub-tank being mounted on the carriage together with the record head for receiving replenishment with ink via an ink replenishment passage from an ink cartridge forming a main tank and supplying ink to the record head, wherein air pressure generated by an air pressurizing pump is applied to the ink cartridge and the sub-tank is replenished with ink from the ink cartridge by the action of the air pressure, wherein a cartridge holder loaded with the ink cartridge detachably is provided with a cover member opened for attaching or detaching the ink cartridge and atmosphere release means for opening an air flow passage from the air pressurizing pump to the ink cartridge into the atmosphere as the cover member is opened is provided.

In this case, preferable the ink replenishment passage from the ink cartridge to the sub-tank is implemented as a flexible ink replenishment tube.

Preferably, the ink cartridge has an outer shell formed in a hermetic state and stores an ink pack formed of a flexible material in which ink is sealed and the air pressure generated by the air pressurizing pump is applied to space formed by an outer shell component of the ink cartridge and the ink pack.

In a preferred embodiment of the ink jet recording apparatus according to the fifth aspect of the invention, an ink replenishment valve is placed on the ink replenishment passage between the ink cartridge and the sub-tank and is opened or closed by a control signal generated by ink amount detection means for detecting the amount of ink in the sub-tank.

It is desirable that the cartridge holder should be loaded detachably with a plurality of ink cartridges for sealing inks ejected through the record head and air pressure generated by one air pressurizing pump should be applied via the air flow passage to each of the ink cartridges with which the cartridge holder is loaded.

On the other hand, preferably the cartridge holder comprises an electric switch for detecting the cover member being open and an on-off valve unit implementing the atmosphere release means is opened with the operation of the electric switch.

In this case, a diaphragm valve is placed in the on-off valve unit and is opened or closed by drive means driven with the operation of the electric switch. In this case, further the drive means preferably is implemented as an electromagnetic plunger.

In a preferred embodiment, the drive force of the electromagnetic plunger acts on one end part of a drive lever rotated via a support shaft, a spring member for urging in an opposite direction to the rotation direction of the drive lever in the drive state of the electromagnetic plunger is placed at an opposite end part of the drive lever, and a drive shaft for supporting the diaphragm valve in the on-off valve unit is joined between the one end part of the drive lever and the support shaft and opens the diaphragm valve by the urging force of the spring member when the electromagnetic plunger is non-energized.

In addition, it is desirable that in the recording apparatus having the configuration described above, the atmosphere release means should also serve as a pressure regulating valve for releasing pressure when the air pressure pressurized by the air pressurizing pump reaches a predetermined or more pressure for maintaining the air pressure applied to the ink cartridge in a predetermined range.

Further, it is desirable that in the regarding apparatus having the configuration described above, driving the air pressurizing pump should be stopped in association with opening of the cover member put on the cartridge holder.

According to the ink jet recording apparatus according to the fifth aspect of the invention described above, the air pressure generated by the air pressurizing pump is applied to the ink cartridge, so that the sub-tank mounted on the carriage can be replenished with necessary and sufficient ink from the ink cartridge.

The atmosphere release means placed on the air flow passage from the pressurizing pump to the ink cartridge releases the pressurized air into the atmosphere in association with the operation of the cover member opened when the ink cartridge is attached or detached.

Therefore, when the ink cartridge placed in the cartridge holder, to which pressurized air is applied, is drawn out from the cartridge holder, application of the pressurized air to the ink cartridge is reliably released.

Thus, the problem of accidentally blowing out ink by the action of the remaining pressurized air in the ink cartridge when the cartridge is drawn out from the holder can be circumvented.

The outer shell member of the ink cartridge a little expanded upon reception of the action of the pressurized air with the ink cartridge placed in the cartridge holder is also restored to the original shape as the cover member is opened, so that drawing out the ink cartridge from the holder can be facilitated, and the problem of damage to both the cartridge and the holder in the drawing out operation can also be circumvented According to a sixth aspect of the invention, there is provided an ink jet recording apparatus wherein pressurized air generated by an air pressurizing pump is applied to a main tank storing ink and a record head mounted on a carriage is replenished with ink from the main tank by the action of the pressurized air and wherein a pressure detector comprising a diaphragm being displaced upon reception of the pressurized air and signal generation means for generating a pressure sense signal based on the displacement amount of the diaphragm is placed on an air flow passage between the air pressurizing pump and the main tank, wherein the diaphragm is formed of a material having hardness changed so as to become high in a low temperature state and low in a high temperature state and wherein driving the air pressurizing pump is controlled based on the pressure sense signal generated by the signal generation means.

The diaphragm may be formed of a material having a volume changed so as to contract in a low temperature state and expand in a high temperature state and driving the air pressurizing pump can also be controlled based on the pressure sense signal generated by the signal generation means.

Further, a moving member for mechanically joining the diaphragm and the signal generation means can also be formed of a material having a size in a moving direction changed so as to contract in a low temperature state and expand in a high temperature state and driving the air pressurizing pump can also be controlled based on the pressure sense signal generated by the signal generation means.

In this case, it is desirable that the temperature dependency characteristic of the value of pressure to generate the pressure sense signal by the signal generation means should be almost equal to the temperature dependency characteristic in the viscosity of ink with which the record head is replenished from the main tank.

It is desirable that the temperature dependency characteristic of the value of pressure to generate the pressure sense signal by the signal generation means should be almost equal to the temperature dependency characteristic in the pressure loss on a replenishment passage of ink with which the record head is replenished from the main tank.

Preferably, a sub-tank mounted on the carriage is replenished with ink via an ink replenishment passage from the main tank and ink is supplied from the sub-tank to the record head mounted on the carriage.

In addition, the ink replenishment passage from the main tank to the sub-tank is implemented as a flexible ink replenishment tube.

In a preferred embodiment of the ink jet recording apparatus according to the sixth aspect of the invention, the signal generation means comprises a moving member made to advance or retreat by replacement of the diaphragm and a photosensor made up of a light source and a light receiving element placed so as to cross a move path of the moving member and generates the pressure sense signal based on output of the light receiving element forming a part of the photosensor.

In another preferred embodiment, the signal generation means comprises a moving member made to advance or retreat by replacement of the diaphragm and a photosensor made up of a light source for projecting light onto a move path of the moving member and a light receiving element for receiving reflected light of the light source based on a move of the moving member and generates the pressure sense signal based on output of the light receiving element forming a part of the photosensor.

In any forms of the ink jet recording apparatus described above, the following configuration can be adopted: The diaphragm is formed of an elastic material and the moving member is made to advance or retreat based on replacement of the diaphragm depending on balance of the air pressure received by the diaphragm and the restoration force of the diaphragm.

It is desirable that the moving member should be formed with a step part for preventing the diaphragm from being excessively displaced by the air pressure.

The following configuration can also be adopted: The ink jet recording apparatus further comprises a spring member for urging in a restoration direction of the diaphragm wherein the moving member is made to advance or retreat based on replacement of the diaphragm depending on balance of the air pressure received by the diaphragm, the restoration force of the diaphragm, and the urging force of the spring member.

It is desirable that the ink jet recording apparatus should further comprise a stopper member for receiving the urging force of the spring member and blocking excessive displacement of the diaphragm.

On the other hand, preferably the diaphragm is formed of rubber.

The diaphragm may be formed of rubber and a cloth. In this case, it is desirable that the rubber should be NBR and have a rubber hardness of 40 to 60 degrees.

According to the ink jet recording apparatus according to the sixth aspect of the invention described above, the following problem can be circumvented: As the ink velocity is changed when the environmental temperature is changed, the flow velocity of the ink with which the sub-tank is replenished from the main tank becomes low in a low temperature state and is increased as the temperature is raised.

That is, as first means, the diaphragm contained in the pressure detector is formed of a material having hardness changed so as to become high in a low temperature state and low in a high temperature state.

Thus, driving the moving member as the diaphragm is displaced is suppressed in the low temperature state, so that the value of pressure when the photosensor detects the move state of the moving member becomes high. Therefore, driving the air pressurizing pump is continued, thereby increasing the flow velocity of ink with which the sub-tank is replenished from the main tank.

On the other hand, driving the moving member as the diaphragm is displaced is promoted in the high temperature state, and the value of pressure when the photosensor detects the move state of the moving member becomes low. Therefore, driving the air pressurizing pump is stopped at an early stage, thereby decreasing the flow velocity of ink with which the sub-tank is replenished from the main tanks.

As second means, the diaphragm contained in the pressure detector is formed of a material having a volume changed so as to contract in a low temperature state and expand in a high temperature state, whereby in the low temperature state, the diaphragm contracts and substantially the moving member is shifted away from the sense area of the photosensor, so that the value of pressure when the photosensor detects the move state of the moving member becomes high.

Therefore, driving the air pressurizing pump is continued, thereby increasing the flow velocity of ink with which the sub-tank is replenished from the main tank.

On the other hand, in the high temperature state, the diaphragm expands and substantially the moving member is shifted toward the sense area of the photosensor, so that the value of pressure when the photosensor detects the move state of the moving member becomes low. Therefore, driving the air pressurizing pump is stopped at an early stage, thereby decreasing the flow velocity of ink with which the sub-tank is replenished from the main tank.

Further, as third means, the moving member for mechanically joining the diaphragm and the signal generation means is formed of a material having the size in the moving direction changed so as to contract in a low temperature state and expand in a high temperature state, whereby in the low temperature state, the moving member contracts and substantially the tip of the moving member is shifted away from the sense area of the photosensor, so that the value of pressure when the photosensor detects the move state of the moving member becomes high.

Therefore, driving the air pressurizing pump is continued, thereby increasing the flow velocity of ink with which the sub-tank is replenished from the main tank.

On the other hand, in the high temperature state, the moving member expands and substantially the tip of the moving member is shifted toward the sense area of the photosensor, so that the value of pressure when the photosensor detects the move state of the moving member becomes low. Therefore, driving the air pressurizing pump is stopped at an early stage, thereby decreasing the flow velocity of ink with which the sub-tank is replenished from the main tank.

The pressure detector having the function described above is adopted, whereby the change amount of the flow velocity of the ink with which the sub-tank is replenished from the main tank can be maintained in the predetermined range if the environmental temperature is changed.

The above-described function can be provided according to the comparatively simple configuration of the diaphragm the photosensor and thus can be realized at comparatively low costs.

The present disclosure relates to the subject matter contained in Japanese patent application Nos.

2000-12460 (filed on Jan. 21, 2000), 2000-24417 (filed on Feb. 1, 2000), 2000-24421 (filed on Feb. 1, 2000), 2000-69692 (filed on Mar. 14, 2000), and 2000-189520 (filed on Jun. 23, 2000), which are expressly incorporated herein by reference in their entireties.

DESCRIPTION OF THE PREFERRED EMBODIMENT

First to sixth embodiments of an ink cartridge according to the present invention will be described by reference to illustrated examples.

Basic Construction of Ink-Jet Recording Apparatus

Figure 1:
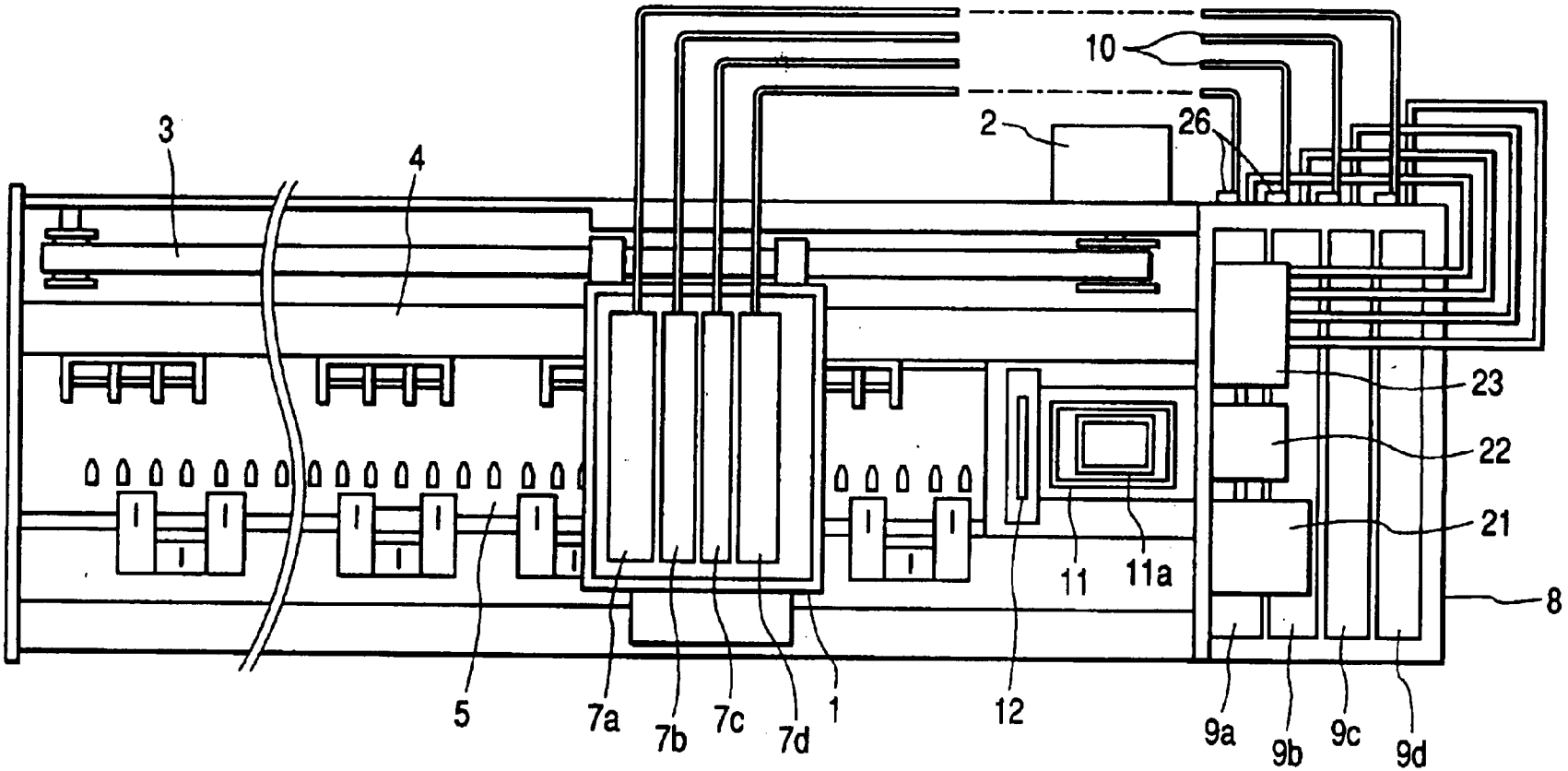
FIG. 1 is a top view to show the general configuration of an ink jet recording apparatus incorporating the invention.

FIG. 1 is a top view showing an example of a basic construction of an ink-jet recording apparatus to which the present invention is applicable. As shown in FIG. 1, reference numeral 1 designates a carriage. The carriage 1 is constructed so as to cause reciprocatory movement in the longitudinal direction of a paper feed member 5; that is, in the primary scanning direction identical with the widthwise direction of recording paper, while being guided by a scan guide member 4 by way of a timing belt 3 driven by a carriage motor 2.

Although not shown in FIG. 1, an ink-jet recording head 6 to be described later is mounted on the surface of the carriage 1, which surface opposes the paper feed member 5.

Sub-tanks 7*a* through 7*d* for supplying ink to the recording head are mounted on the carriage 1. In this construction, four sub-tanks 7*a* through 7*d* are provided so as to correspond to the types of ink and for temporarily storing the ink therein.

The sub-tanks 7*a* through 7*d* are constructed such that black ink, yellow ink, magenta ink, and cyan ink are supplied to the sub-tanks 7*a* through 7*d* from corresponding main tanks 9*a* through 9*d* through flexible ink supply tubes 10, respectively. The main tanks 9*a* through 9*d*, i.e. ink cartridges, are attached to a cartridge holder 8 provided on an end portion of the recording apparatus.

Capping means 11 capable of sealing a nozzle-formed plane of the recording head is disposed in a non-print region (i.e., at the home position) on the travel path of the carriage 1. A cap member 11*a*—which is formed from flexible material, such as rubber, that is capable of sealing a nozzle-formed plane of the recording head—is attached to the upper surface of the capping means 11.

The capping means 11 is moved upwardly when the carriage 1 is moved to the home position, thereby seal the nozzle-formed plane of the recording head with the cap member 11*a*.

During the non-operating period of the recording apparatus, the cap member 11*a* seals the nozzle-formed plane of the recording head, thereby acting as a cover for preventing drying of nozzle orifices. Although not depicted, one end of a tube of a suction pump (i.e., a tube pump) is connected to the cap member 11*a*, so that negative pressure generated by the suction pump is applied to the recording head, to thereby perform a cleaning operation for causing the recording head to discharge ink under suction.

A wiping member 12 formed from resilient material, such as rubber, is disposed adjacent to a print region side of the capping means 11 so as to wipe and clean the nozzle-formed plane of the recording head as required.

Figure 2:
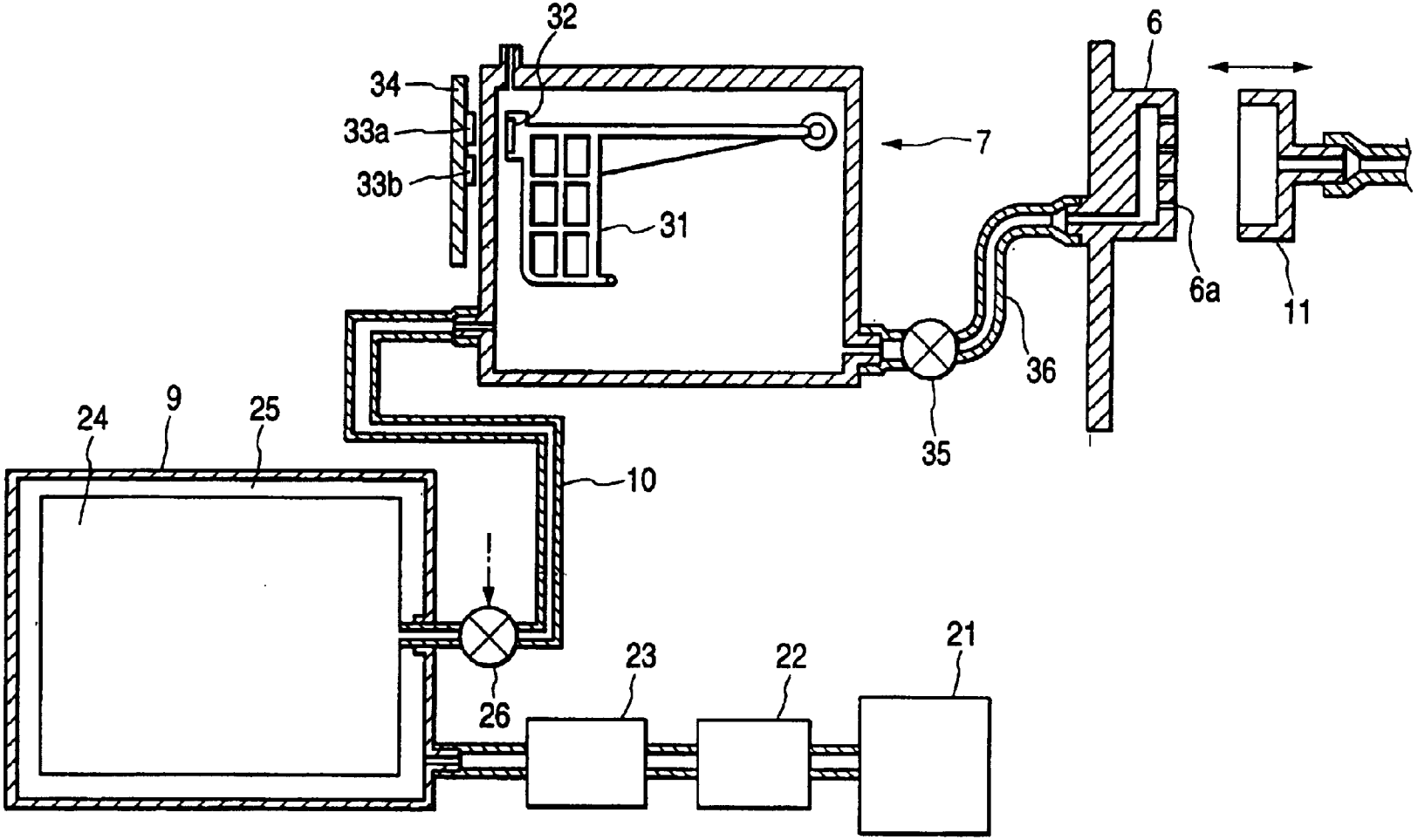
FIG. 2 is a schematic drawing to show an ink supply system from main tanks (ink cartridge) to a record head.

FIG. 2 is a schematic drawing showing an ink supply system extending from an ink cartridge to a recording head in the recording apparatus shown in FIG. 1. The ink supply system will now be described by reference to FIG. 2 in conjunction with FIG. 1, in which like elements are assigned like reference numerals.

Referring to FIGS. 1 and 2, reference numeral 21 designates an air pressurization pump. The air pressurized by the air pressurization pump 21 is supplied to a pressure regulation valve 22 serving also as an atmosphere release valve. The pressurized air is supplied to the respective main tanks 9*a* through 9*d* (the main tanks are designated in FIG. 2 by simply reference numeral 9, and the main tanks will often be described in singular form by use of only reference numeral 9) by way of a pressure detector 23.

The air flow passage branches from the pressure detector 23 to the main tanks 9 so that the pressurized air is applied to each of the main tanks mounted to the cartridge holder 8.

The specific construction of the pressure regulating valve 22 also serving as the atmosphere release valve will be discussed later in detail, but the pressure regulating valve 22 has a function of maintaining the air pressure applied to the main tanks 9*a* through 9*d* within a predetermined range by releasing the pressure when the air pressure pressurized by the air pressurizing pump 21 reaches an excessive state due to some reasons.

The atmosphere release valve has a function of canceling the pressurized state established by the air pressurizing pump 21, for example, when a cover member (described later) attached to the cartridge holder is open, or when the drive power for the recording apparatus is turned off.

The pressure detector 23 operates so as to detect the air pressurized by the air pressurization pump 21 and control the operation of the air pressurization pump 21.

More specifically, when having detected that the air pressurized by the air pressurization pump 21 has reached a predetermined pressure level, the pressure detector 23 stops actuation of the pressurization pump 21 on the basis of the detection result. In contrast, when having detected that the air pressure has fallen below a predetermined pressure level, the pressure detector 23 performs control operation so as to actuate the air pressurization pump 21. By repetition of these operations, the air pressure applied to the main tanks 9*a* through 9*d* is maintained within the predetermined range.

As the construction of the main tank 9 is schematically shown in FIG. 2, the outer shell of the main tank 9 is formed hermetically. An ink pack 24 which is filled with ink and is formed from resilient material is housed in the main tank 9.

The space defined by combination of the main tank 9 and the ink pack 24 constitutes a pressure chamber 25, and the pressurized air is supplied to the pressure chamber 25 by way of the pressure detector 23.

With such a construction, the ink packs 24 housed in the main tanks 9*a* through 9*d* are subjected to pressure stemming from the pressurized air, whereby ink flows from the main tanks 9*a* through 9*d* to the corresponding sub-tanks 7*a* through 7*d* under predetermined pressure.

The ink pressurized in each of the main tanks 9*a* through 9*d* is supplied to the corresponding one of the sub-tanks 7*a* through 7*d* mounted on the carriage 1, by way of the corresponding one of ink supply valves 26 and the corresponding one of the ink supply tubes 10 (the sub-tanks are designated in FIG. 2 by use of simply reference numeral 7, and hereinafter the sub-tanks will often be described in singular form by use of simply reference numeral 7).

The construction of the sub-tank 7 shown in FIG. 7 will be discussed in detail later, but as shown in FIG. 2, the sub-tank 7 is basically constructed as follows: A float member 31 is provided within the sub-tank 7, and a permanent magnet 32 is attached to a part of the float member 31. Magnetoelectric converter elements 33*a* and 33*b* typified by Hall elements are mounted on a board 34, and the board 34 is disposed in close proximity to the side wall of the sub-tank 7.

With such an arrangement, the permanent magnet 32 provided on the float member 31 and the Hall elements 33*a* and 33*b* constitute ink level detection means. In accordance with the amount of lines of magnetic force developing in the permanent magnet 32 according to the position of the float member 31, an electrical output is produced by the Hall elements 33*a* and 33*b*.

When the level of the ink stored in the sub-tank 7 has lowered, the float member 31 housed in the sub-tank 7 is moved under the force of gravity. In association with this movement, the permanent magnet 32 is also moved in the same direction.

The electrical output produced by the Hall elements 33*a* and 33*b* in association with movement of the permanent magnet 32 can be sensed as the level of the ink stored in the sub-tank 7. On the basis of the electrical output produced by the Hall elements 33*a* and 33*b*, the ink supply valve 26 is opened. As a result, the pressurized ink in the main tank 9 is supplied to each corresponding sub-tank 7 whose ink level has lowered.

When the ink stored in the sub-tank 7 has risen to a predetermined level, the ink supply valve 26 is closed on the basis of the electrical output produced by the Hall elements 33*a* and 33*b*.

By repetition of these operations, ink is intermittently supplied from the main tank 9 to the sub-tank 7, thereby constantly storing substantially a given amount of ink within each sub-tank 7.

With such an arrangement, ink pressurized by the air within each main tank is supplied to a respective sub-tank based on an electrical output indicative of a position of a float member disposed within the sub-tank. Accordingly, an ink replenishing response can be improved, and an amount of ink stored in each sub-tank can be managed appropriately.

The sub-tank 7 is constructed such that ink is supplied from the sub-tank 7 to the recording head 6 by way of a valve 35 and a tube 36 connected thereto. On the basis of print data supplied to an unillustrated actuator of the recording head 6, ink droplets are ejected from nozzle orifices 6*a* formed in the nozzle-formed plane of the recording head 6.

Referring to FIG. 2, reference numeral 11 designates the previously-described capping means, and a tube connected to the capping means 11 is connected to an unillustrated suction pump (i.e., a tube pump).

Figure 3:
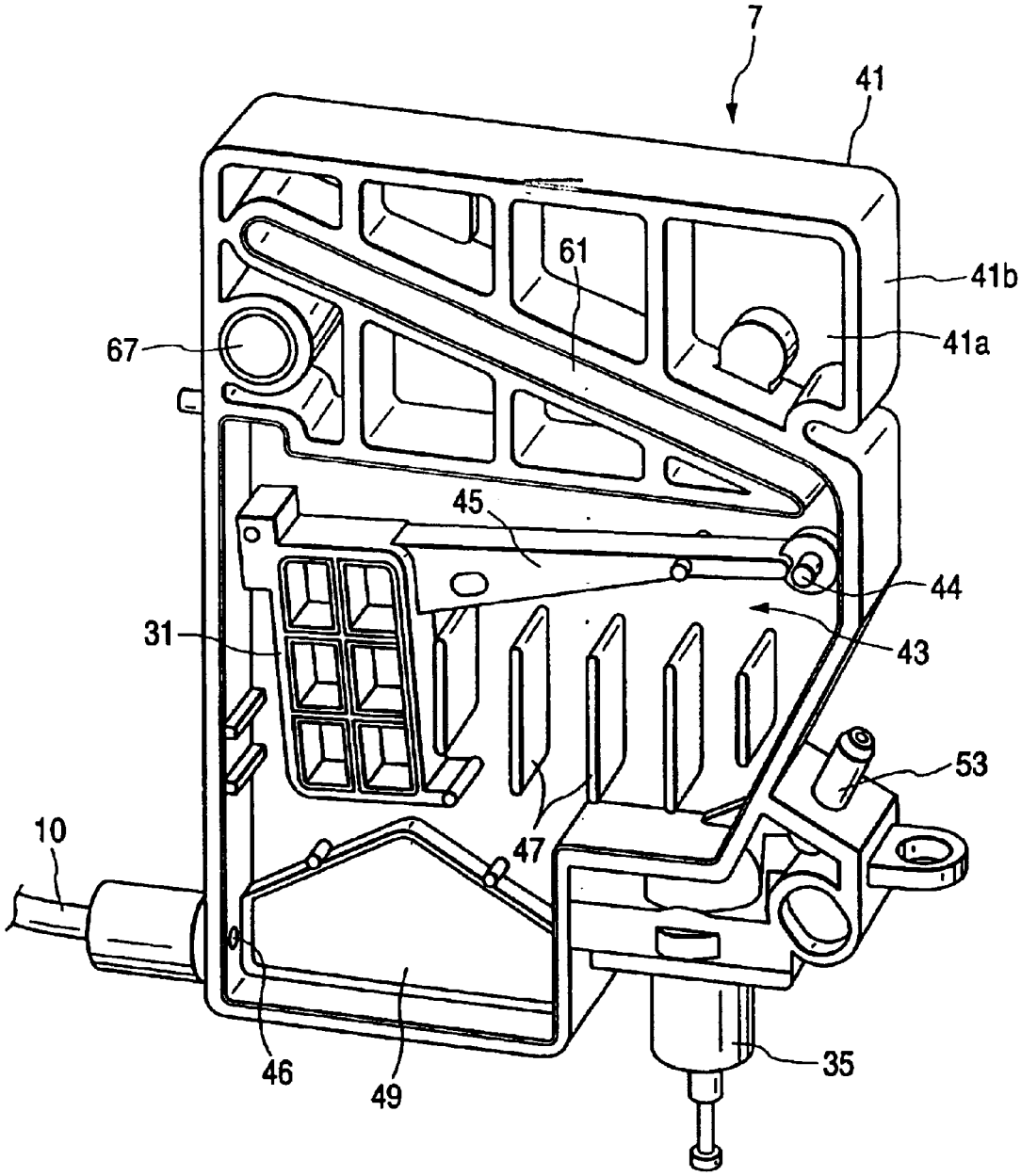
FIG. 3 is a perspective view of a sub-tank from a one-face direction with a part of the sub-tank omitted.
Figure 4:
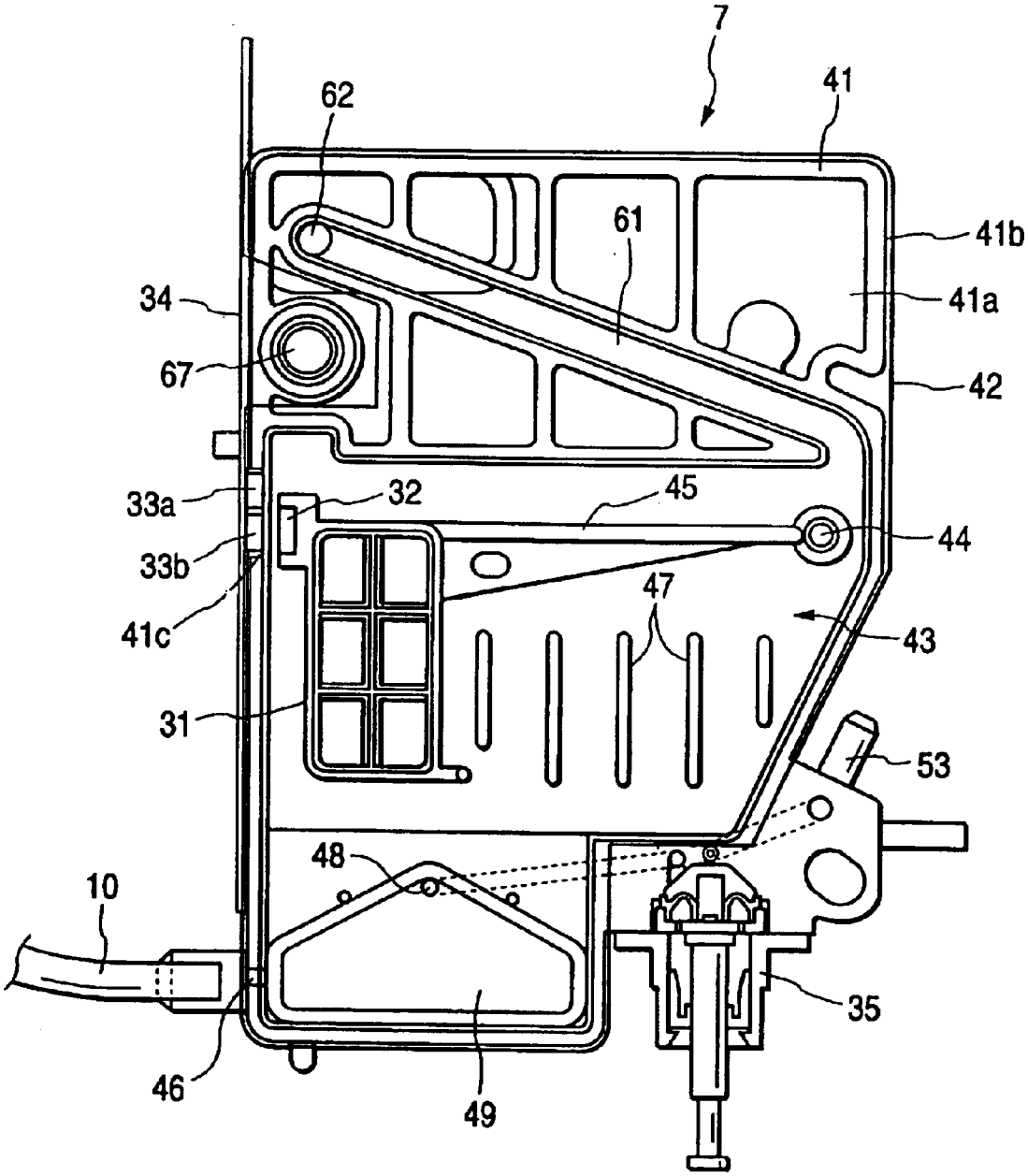
FIG. 4 is a perspective view of the sub-tank from the one-face direction.
Figure 5:
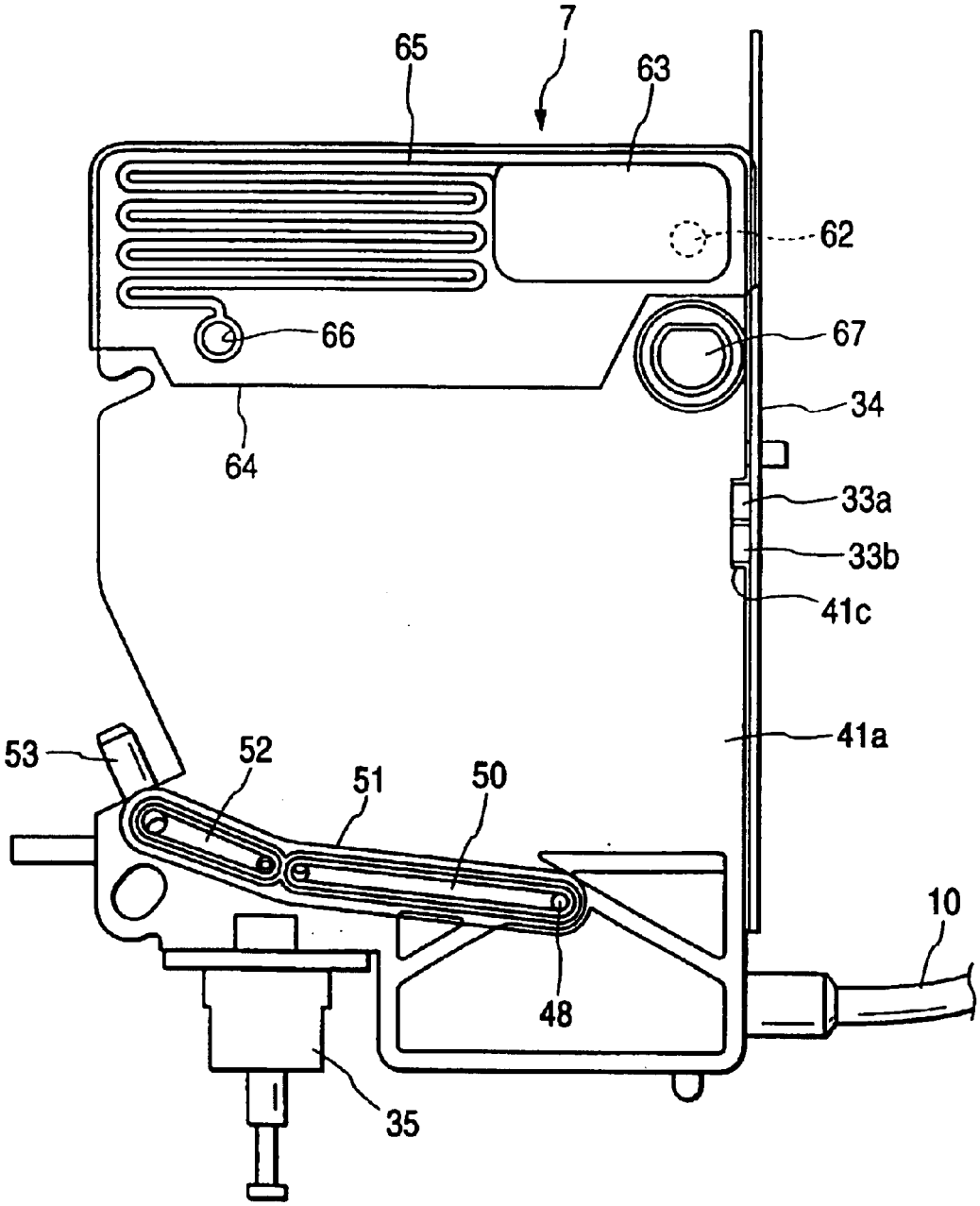
FIG. 5 is a rear view of the sub-tank from the rear direction.

FIGS. 3 to 5 show an example of the sub-tank. FIG. 3 is a perspective view of the sub-tank from a one-face direction with a part of the sub-tank omitted, and FIG. 4 is a perspective view (a projection) of the sub-tank from the same direction. FIG. 5 is a rear view of the sub-tank from the rear direction.

Parts identical with or similar to those previously described with reference to FIGS. 1 and 2 are denoted by the same reference numerals in FIGS. 3 to 5.

The sub-tank 7 is formed almost like a rectangular parallelepiped and the whole of the sub-tank is made flat. an outer shell of the sub-tank 7 includes a box-like member 41 formed with a one side wall 41*a* and a peripheral side wall 41*b* continuous and integral with the side wall 31*a*. A film-like member 42 made of a transparent resin (see FIG. 4) is attached to the opening periphery of the box-like member 41 in a close contact state by thermal welding, so that an ink storage space 43 is formed in the inside surrounded by the box-like member 41 and the film-like member 42.

A support shaft 44 projected from the one side wall 41*a* forming a part of the box-like member 41 to the ink storage space 43 is formed integrally with the box-like member 41. The float member 31 is arranged within the ink storage space 43 and is rotatably movable in the gravity direction about the support shaft 44.

In this example, the support shaft 44 is disposed in the proximity of an end part of the ink storage space 43 in the horizontal direction, and the float member 31 is formed integrally on the movable free end side of a support arm member 45 movable about the support shaft 44.

As shown in FIG. 4, the permanent magnet 32 is attached to the free end side of the support arm member 45. When the support arm member 45 is placed almost in a horizontal state, the permanent magnet 32 is positioned in the proximity of an opposite end part of the ink storage space 43 in the horizontal direction, namely, is brought closest to the hall devices 33*a* and 33*b* mounted on the board 34 attached to the side wall of the sub-tank 7.

On the other hand, the sub-tank 7 is formed with an ink replenishment port 46 in a lower part in the gravity direction, namely, in the bottom of the peripheral side wall 41*b* in this example, and the ink storage space 43 is replenished with ink from the main tank 9 via the tube 10 connected to the ink replenishment port 46.

The ink replenishment port 46 of the sub-tank 7 is formed in the lower part in the gravity direction as mentioned above. Accordingly, ink from the main tank is supplied through the bottom of the ink storage space 43. This arrangement prevents bubbles of ink in the ink storage space 43 as ink is supplied.

Further, the sub-tank 7 is provided with a plurality of rib members 47 for reducing waving of ink in the sub-tank, which would otherwise caused in association with a movement of the carriage. These rib members 47 are located in a region so as not to interfere with a movable regions where the float member 31 and the support arm member 45 are movable.

In this example, each of the rib members 47 is formed integrally with and projected from the one side wall 41*a* as a base toward the ink storage space 43 from, but each of these ribs 47 may be formed as a discrete member to be attached to the one side wall 41*a* of the box-like member 41 forming the sub-tank 7.

The provision of the rib members 47 can reduce the waving of ink in the sub-tank as mentioned above, thereby making it possible to improve the detection accuracy of ink storage amount in the sub-tank 7 by the hall devices.

In the sub-tank 7, an ink outlet 48 is formed in the proximity of the ink replenishment port 46, as shown in FIG. 4.

A filter member 49 of a pentagon (like a home plate) for trapping foreign substances is disposed to cover the ink outlet 48, and therefore ink stored in the sub-tank 7 is guided through the filter member 49 into the ink outlet 48.

Moreover, since the ink outlet 48 is formed in the proximity of the ink replenishment port 46, comparatively new ink introduced into the sub-tank 7 is immediately supplied through the ink outlet 48 to the record head.

As shown in FIG. 5, ink derived from the ink outlet 48 is introduced into a groove part 50 formed in the rear of the side wall 41*a*, and is led to the valve 35 placed at the bottom of the sub-tank 7 via an ink outlet passage that is formed by the groove part 50 and a film-like member 51 thermally welded to cover the groove part 50.

The ink is introduced through the valve 35 into a groove part 52 formed in the rear of the sidewall 41*a*, and is led to a connection port 53 of the tube 36 connected to the record head 6, via an ink outlet passage that is formed by the groove part 52 and the film-like member 51 thermally welded to cover the groove part 52.

On the other hand, as shown in FIGS. 3 and 4, a conduction groove 61 leading to the ink storage space 43 is formed in the upper half portion of the sub-tank 7 in a slant state, and an atmosphere communication port 62 piercing through the side wall 41*a* of the sub-tank 7 to the rear of the side wall 41*a* is formed in the upper end part of the conduction groove 61, namely, in a high place in the gravity direction of the sub-tank 7.

As shown in FIG. 5, the atmosphere communication port 62 is disposed in the rear of the sub-tank 7 and is blocked by a water repellent film 63 formed almost like a rectangle for allowing the atmosphere to pass through and blocking passage of ink.

The water repellent film 63 is placed in such a manner that the film 63 is stored in a recess formed in the rear on the side wall 41*a* of the sub-tank 7 and is held by a film-like member 64 thermally welded so as to cover the upper rear of the side wall 41*a*.

A meandering groove 65 is formed in the rear of the side wall 41*a* via the water repellent film 63 and communicates at one end thereof with a blind hole 66 formed in the side wall 41*a* of the sub-tank 7.

The meandering groove 65 and the blind hole 66 are covered with the film-like member 64 in a hermetic state, and therefore the meandering groove 65 and the film-like member 64 form an air circulation resistance passage (denoted by the same reference numeral as the meandering groove 65).

The film-like member 64 covering the blind hole 66 is broken with a sharp tool, etc., for example, whereby the atmosphere release port 62 is allowed to communicate with the atmosphere via the air circulation resistance passage formed like meandering.

Since the atmosphere release port 62 formed in the sub-tank 7 is thus covered with the water repellent film 63, a problem of leaking ink from the sub-tank 7 if the recording apparatus is upside down, for example, by mistake can be circumvented in the presence of the water repellent film 63.

The blind hole 66 in the end part of the air circulation resistance passage 65 is previously covered with the film-like member 64 in a hermetic state. Accordingly, liquid leakage (ink leakage) of the sub-tank can be checked when the sub-tank is completed, and upon completion of the checking, the film-like member 64 covering the blind hole 66 is broken to provide the essential function.

The side wall of the sub-tank 7 is formed with a recess part 41*c* for positioning the hall devices 33*a* and 33*b*, so that the side wall portion of the sub-tank 7 can be made thinner and the distance between the moving path of the permanent magnet 32 attached to the float member 31 and the hall device 33*a*, 33*b* can be made shorter.

Thus, the sensitivity of the hall devices 33*a* and 33*b* for detecting the magnetic force line of the permanent magnet 32 can be enhanced and the ink amount detection accuracy as the float member 31 moves in the gravity direction in response to the amount of ink in the sub-tank 7 can also be enhanced.

As shown in FIGS. 4 and 5, the hall devices 33*a* and 33*b* are juxtaposed vertically along the moving path of the permanent magnet 32, so that the hall devices 33*a* and 33*b* can generate output signals different in phase in conjunction with a movement of the permanent magnet 32 attached to the float member 31.

That is, taking the operation of replenishing the sub-tank with ink as an example, as the float member moves upwardly in response to replenishing with ink, first the magnetic force line acts largely on the second hall device 33*b* and further when replenishing with ink is continued, the magnetic force line acts largely on the first hall device 33*a*.

Therefore, if output of the hall devices 33*a* and 33*b* is converted into a binary signal using a predetermined threshold voltage, combinations of (00), (01), (11), and (10) can be obtained and it is made possible to recognize the amount of ink in the sub-tank with excellent accuracy.

This is also applied to the case where the amount of ink in the sub-tank is gradually lowered, for example, by the print operation, and therefore the lowering state can be recognized with excellent accuracy.

The ink replenishment valve 26 corresponding to the sub-tank with the ink amount decreased is opened using the electric output provided by the hall devices 33*a* and 33*b*, whereby the sub-tank is replenished with a proper amount of ink, as described above.

A through hole 67 is formed in a part of the sub-tank 7 as shown in FIGS. 3 to 5.

Therefore, one support shaft (not shown) piercing through the through holes 67 of the sub-tanks 7 can be used to arrange the sub-tanks in a parallel or juxtaposed state, thereby forming a sub-tank unit.

Figure 6:
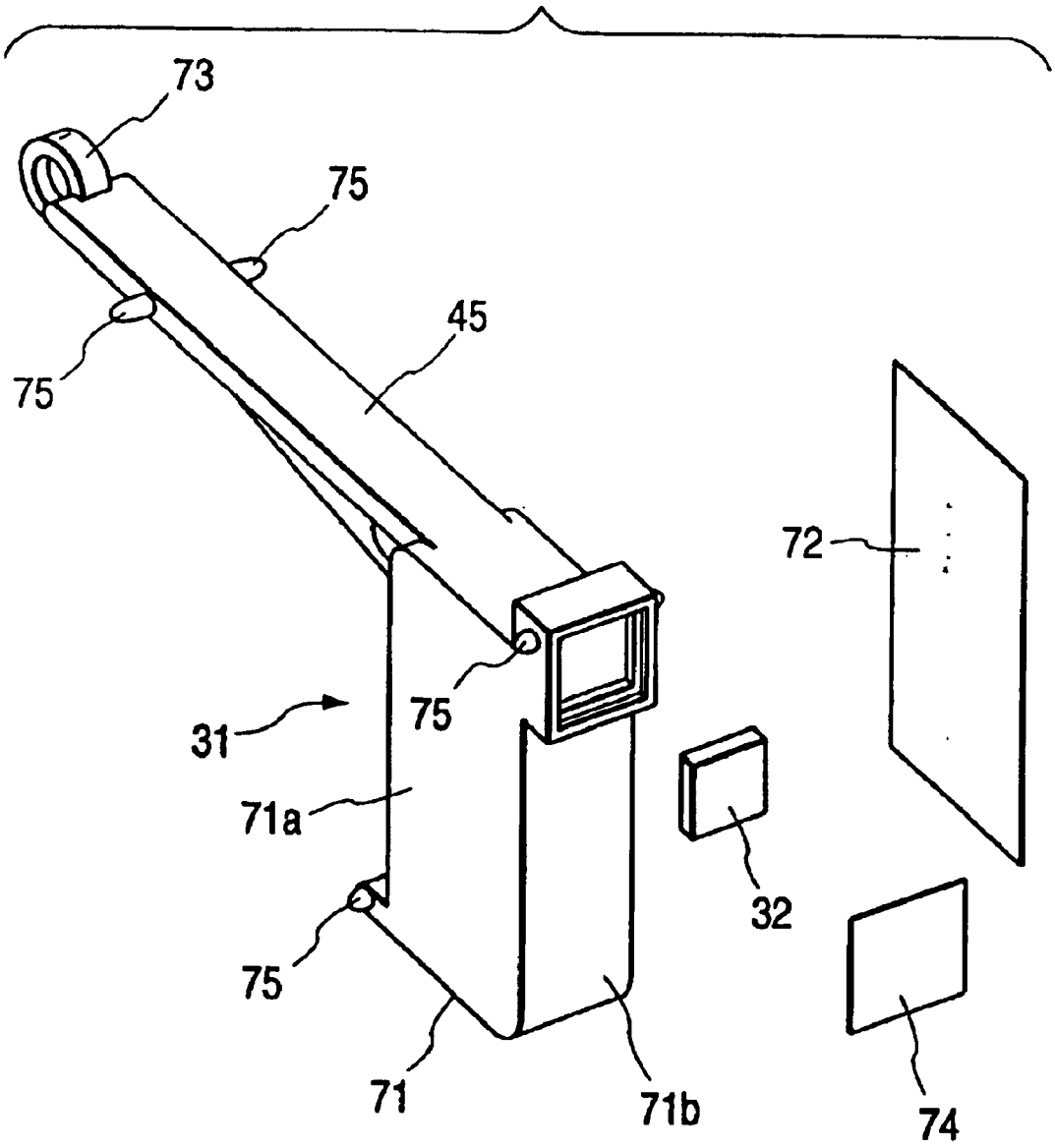
FIG. 6 is an exploded perspective view to show the configuration of a float member housed in the sub-tank.

Next, FIG. 6 is an exploded perspective view to show a construction of an example of the float member 31. The float member 31 of this example includes a box-like member 71 formed with a one side wall 71*a* and a peripheral side wall 71*b* continuous to and integral with the one side wall, and a closure member 72 for closing an opening part of the box-like member 71 to form an hollow interior.

For example, a film-like member formed of a transparent resin is used as the closure member 72. The film-like closure member 72 is attached to the opening periphery of the box-like member 71 in a close contact state by, for example, thermal welding, thereby defining a hollow interior.

The float member 31 thus formed is integral with the moving free end side of the support arm member 45 movable about the support shaft 44 formed in the sub-tank 7, as described above.

A support ring 73 is formed integrally on the base end part of the support arm member 45, and is rotatably mounted on the support shaft 44 so that the support arm member 45 is rotatable about the support shaft 44.

The permanent magnet 32 is attached to the free end side of the support arm member 45 as described above, and is covered with a film-like member 74 put on the surface of the permanent magnet 32 so as to avoid the chemically adverse effect of ink stored in the sub-tank 7.

Further, the float member 31 and the support arm member 45 are formed in part with positioning pins 75 at three locations so that the positioning pins 75 project to both outsides in the horizontal direction.

It is desirable that the positioning pins 75 project 1 mm or more from both sides of the float member 31 so as to hold a distance of at least 1 mm or more between each of the float member 31 and the support arm member 45 and the inner wall of the sub-tank.

This arrangement makes it possible to avoid a problem in that the surface tension of ink acts between the float member 31 and the inner wall of the sub-tank 7 to inhibit the movement of the float member 31.

First Embodiment

An example of a pressure regulating valve serving also as an atmosphere release valve will be described, which is applicable to a recording apparatus having the construction discussed in connection with the background art and/or the basic construction discussed above so as to constitute a recording apparatus of a first embodiment.

Figure 7:
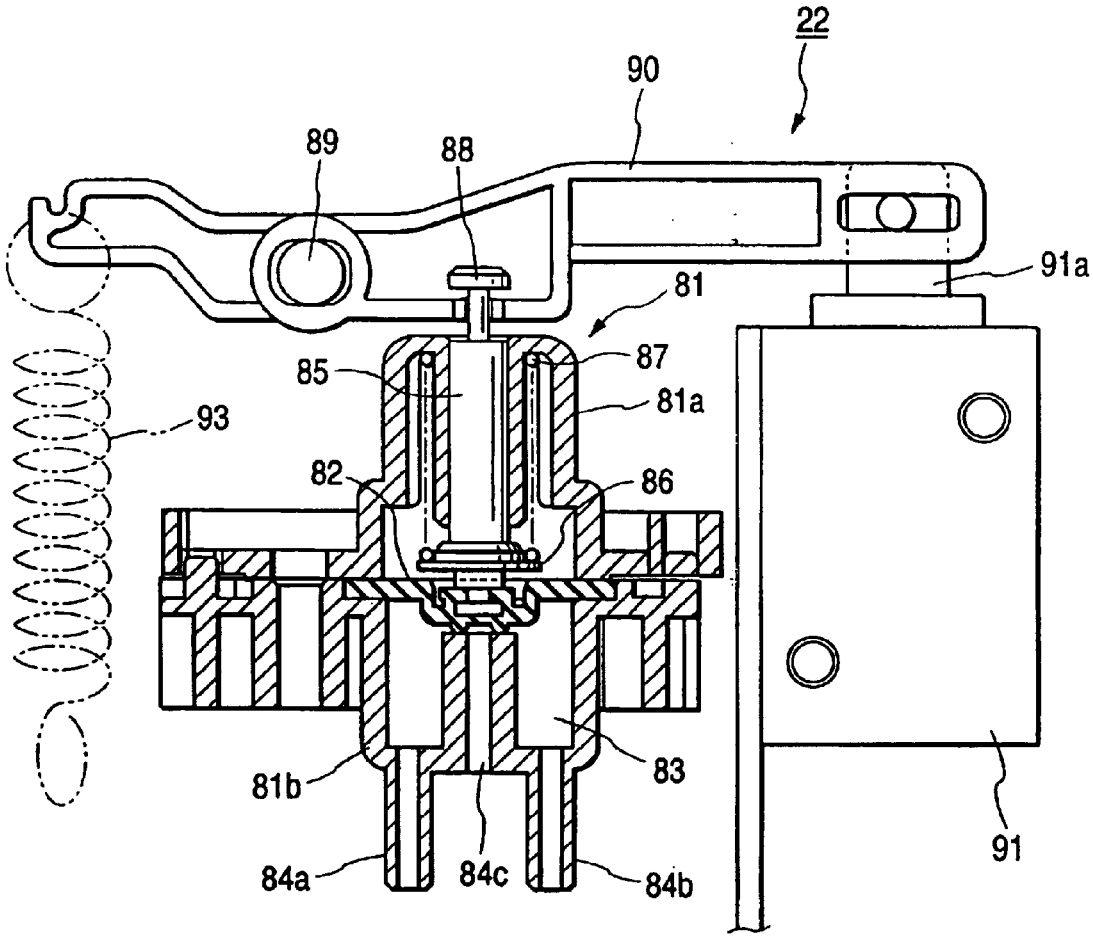
FIG. 7 is a partly sectional view to show a state in which an on-off valve unit functions as a pressure regulating valve.
Figure 8:
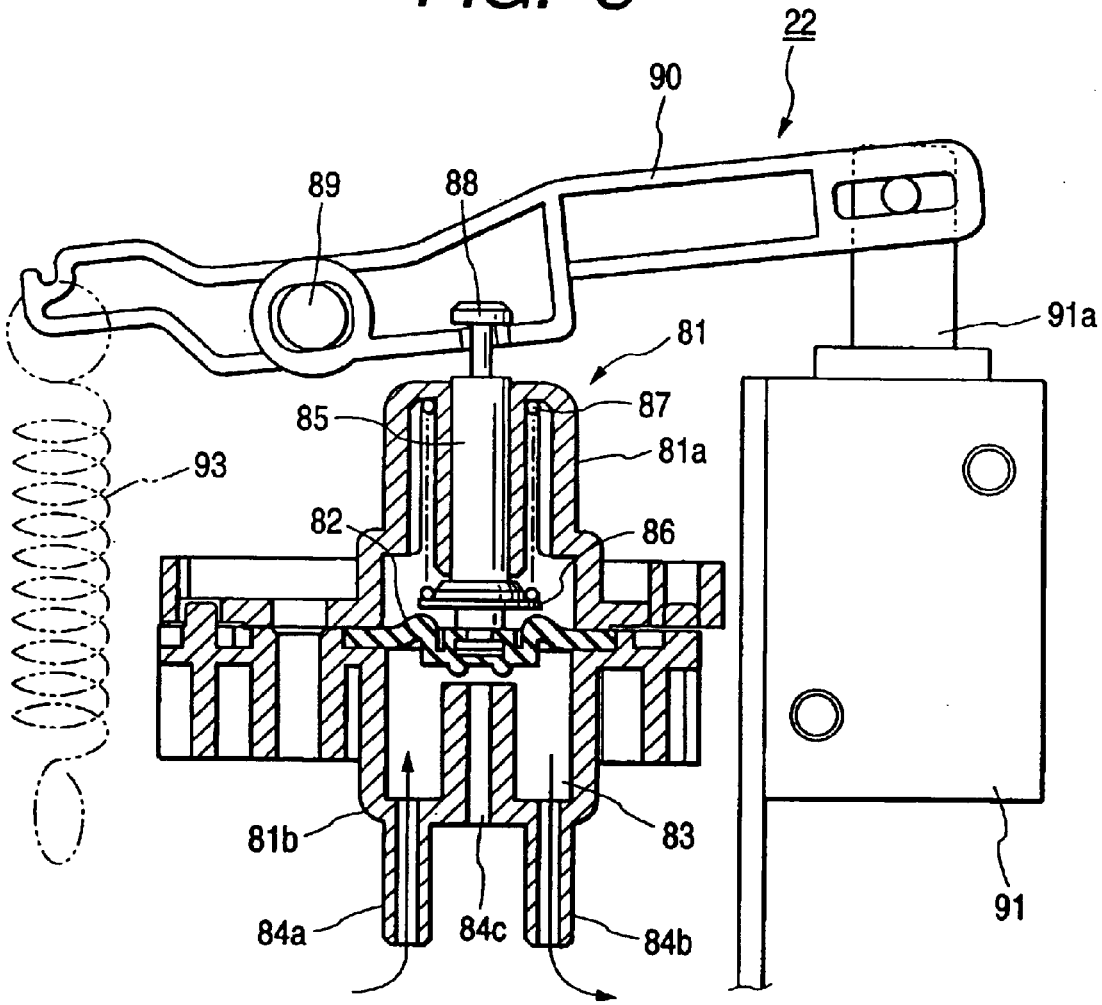
FIG. 8 is a partly sectional view to show a state in which the on-off valve unit shown in FIG. 7 is placed in an atmosphere release state.

FIGS. 7 and 8 are partly sectional views to show the example of the pressure regulating valve 22 also serving as the atmosphere release valve with the main part in section. FIG. 7 shows a state in which the valve functions as the pressure regulating valve, and FIG. 8 shows an atmosphere release state.

In FIGS. 7 and 8, numeral 81 denotes an on-off valve unit. The on-off valve unit 81 includes an upper case 81*a* and a lower case 81*b*, each formed with an internal space, and can be divided vertically by the upper case 81*a* and the lower case 81*b*.

A diaphragm valve 82 is arranged at a joint part, i.e. a boundary, between the upper case 81*a* and the lower case 81*b*.

The diaphragm valve 82 is provided by molding a rubber material into a disk-like form, and has a peripheral portion clamped at the joint part by the upper case 81*a* and the lower case 81*b* to define an air chamber 83 in a hermetic state in the space of the lower case 81*b*.

The lower case 81*b* is also formed with a pair of connection tubes 84*a* and 84*b* communicating with the air chamber 83, and the connection tubes 84*a* and 84*b* are connected to the air pressurizing pump 21 and the pressure detector 23, respectively.

Therefore, as shown by arrow lines in FIG. 8, pressurized air is from the air pressurizing pump 21 through the air chamber 83 to the pressure detector 23 and each main tank 9.

A ventilation hole 84*c* is formed in the center of the lower case 81*b*, and a substantially central part of the diaphragm valve 82 abuts the opening end of the ventilation hole 84*c* where the ventilation hole 84*c* is open to the air chamber 83.

On the other hand, a drive shaft 85 is vertically slidably arranged in the upper case 81*a*, and the upper surface part of the diaphragm valve 82 is supported by the lower end part of the drive shaft 85.

An annular spring seat 86 is attached to the drive shaft 85, and a coiled spring member 87 is interposed between the spring seat 86 and the space upper part of the upper case 81*a*. so that the central part of the diaphragm valve 82 is urged to contact the opening end of the ventilation hole 84*c*.

An engagement head part 88 is provided on the upper end part of the drive shaft 85. More specifically, the engagement head part is attached to the end of the upper part passing through a through hole formed in a drive lever 90 that is supported by a support shaft 89 and rotatable, like a seesaw, about the support shaft 89.

An operational rod 91*a* of an electromagnetic plunger 91 as drive means is engaged with one end part of the drive lever 90. One end of a spring member, namely, a tensile spring 93, is attached to an opposite end part of the drive lever 90 with respect to the support shaft 89, and the drive lever 90 is urged so that it is rotated counterclockwise in this figure by the action of the tensile spring 93.

The engagement head part 88 of the drive shaft 85 in the on-off valve unit 81 is engaged with a middle part of the drive lever 90 located between the one end part of the drive lever 90 receiving the drive force of the electromagnetic plunger 91 and the support shaft 89.

In this construction, when the electromagnetic plunger 91 is energized, the one end part of the drive lever 90 is pulled down against the urging force of the tensile spring 93 as shown in FIG. 7. Therefore, the engagement head part 88 attached to the drive shaft 85 in the on-off valve unit 81 is made to float (i.e. separate) from the drive lever 90.

Thus, the diaphragm valve 82 is brought into a closed valve state in which the diaphragm valve 82 closes the ventilation hole 84*c* by action of the urging force of the spring member 87 and the elastic force possessed by the diaphragm valve 82.

If pressure in the air chamber 83 exceeds a predetermined value, the diaphragm valve 82 is pushed up in the air chamber 83. Accordingly, the contact of the diaphragm valve 82 with the ventilation hole 84*c* is released, and the function of the pressure regulating valve is realized.

Thus, when air pressure pressurized by the air pressurizing pump 21 reaches an excessive state for some fault, the excessive pressure can be released, and the air pressure applied to each of the main tanks 9*a* to 9*d* can be maintained within the predetermined range, as described above.

On the other hand, if energizing the electromagnetic plunger 91 is shut off, as shown in FIG. 8, the drive lever 90 is rotated counterclockwise in the figure by the action of the tensile spring 93, and the drive shaft 85 of the on-off valve unit 81 is pulled up by the tensile force of the tensile spring 93 against the urging force of the spring member 87 in the on-off valve unit 81 and the elastic force of the diaphragm valve 82.

Therefore, the atmosphere release state of releasing the pressurized air through the ventilation hole 84*c* from the air chamber 83 is established.

According to the example shown in FIGS. 7 and 8, when energizing the electromagnetic plunger 91 is shut off, the atmosphere release state is established. Thus, if the recording apparatus is adapted to shut off energizing the electromagnetic plunger 91 when a cover member (to be described later) mounted to the cartridge holder is opened, the air pressure applied to each main tank 9 is instantly released as the cover member is opened.

When the operation power of the recording apparatus is turned off, energizing the electromagnetic plunger 91 is also shut off. Therefore, the pressure is automatically released during the non-operation state of the recording apparatus.

Thus, when the recording apparatus is not used, the air pressure applied to each main tank 9 is released, and the problem of inducing ink leakage from the main tank, for example, by the remaining air pressure during the non-operation state of the recording apparatus can be eliminated.

Figure 9:
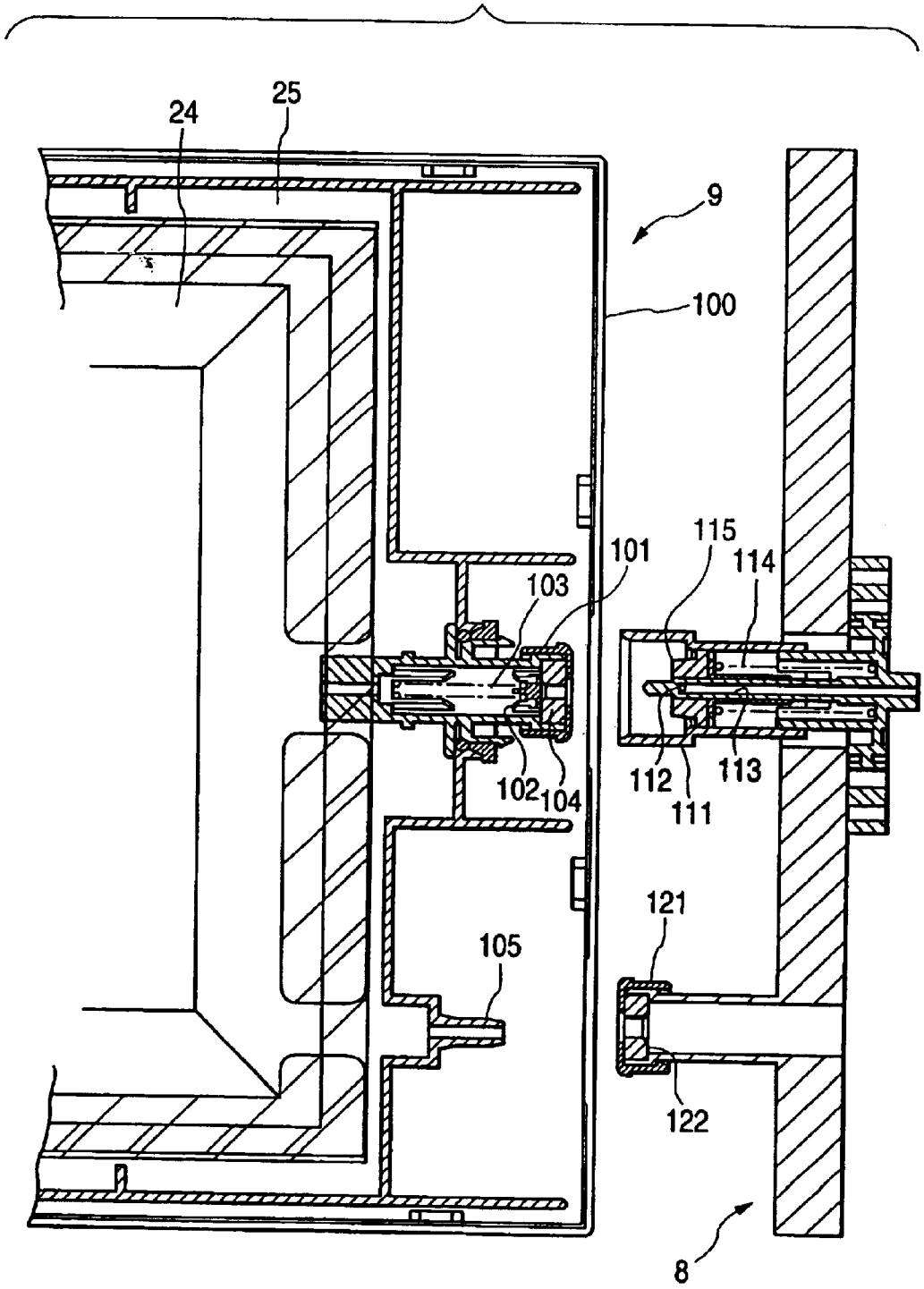
FIG. 9 is a sectional view to show a part of the configurations of an ink cartridge and a cartridge holder.
Figure 10:
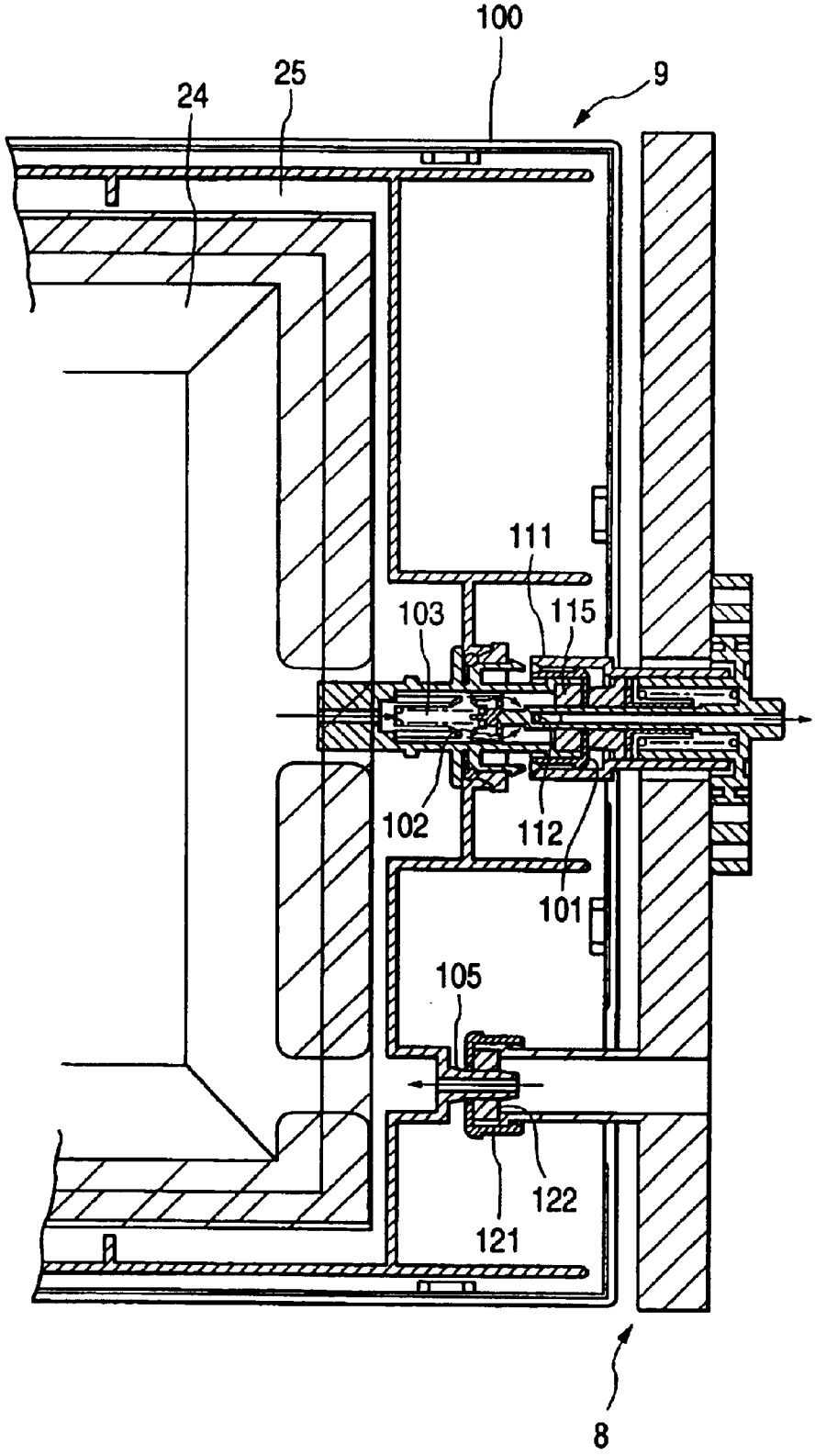
FIG. 10 is a sectional view to show a state in which the main tank is placed in the cartridge holder.

Next, FIGS. 9 and 10 are sectional views to show the construction of a part of the main tank formed with an internal pressure chamber and the construction of a part of the cartridge holder. FIG. 9 shows a state just before the main tank is mounted to the cartridge holder of the recording apparatus (or just after the main tank is removed from the cartridge holder). FIG. 10 shows a state in which the main tank is mounted to the cartridge holder.

Parts identical with those previously described with reference to the accompanying drawings are denoted by the same reference numerals in FIGS. 9 and 10.

An ink outlet plug 101 of the ink pack 24 in which ink is sealingly stored is attached to an end part of a case forming the outer shell member of the main tank.

A valve member 102, which abuts a connection plug (described later) of the cartridge holder to retreats axially, thereby establishing an open valve state, is disposed in the ink outlet plug 101. The valve member 102 is urged by a spring member 103 so as to axially advance. The valve member 102 urged by the spring member 103 so as to axially advance is pressed against an annular packing member 104 formed at the center with a through hole. Consequently, the ink outlet plug 101 is brought into in a closed valve state as shown in FIG. 9.

The case 100 is formed with a pressurized air inlet, which is constructed as a cylindrical member 105 forming an air passage communicating with the pressure chamber 25. The cylindrical member 105 is formed integrally so as to project to the front end part of the main tank.

On the other hand, the cartridge holder 8 is formed at the center with an ink reception connection plug 111 projected from the cartridge holder 8. When the main tank is mounted to the cartridge holder 8, the connection plug 111 is abutted by the ink outlet plug 101 of the main tank to be put into an open valve state. When the main tank is not mounted to the cartridge holder 8, the connection plug 111 is held in a closed valve state.

That is, the connection plug 111 includes a hollow needle 113 formed with an ink introduction hole or ink introduction holes 112, and an annular slide member 115 slidably provided to hollow needle 113 so as to surround the outer periphery of the hollow needle 113. When the main tank is not mounted to the cartridge holder 8, the slide member 115, urged by a spring member 114, is moved to a position closing the ink introduction hole 112 of the hollow needle 113.

Therefore, when the main tank is not mounted as shown in FIG. 9, the slide member 115, receiving the urging force of a spring member 114, advances to close the ink introduction hole 112 formed in the hollow needle 113 (closed valve state).

When the main tank is mounted to the cartridge holder 8 as shown in FIG. 10, the ink outlet plug 101 of the main tank abuts the annular slide member 115 to retract the slide member 115, so that the ink introduction hole 112 in the hollow needle 113 is exposed for allowing ink to be introduced (open valve state).

Concurrently, in the main tank side, the tip part of the hollow needle 113 in the cartridge holder abuts the valve member 102 through the through hole formed in the packing member 104 and retracts the valve member 102 axially. Accordingly, the ink outlet plug 101 of the main tank is also opened.

Thus, ink can be supplied from the main tank to the cartridge holder as indicated by the arrow in FIG. 10.

Simultaneously, the cylindrical member 105 defining the pressurized air inlet of the ink cartridge is also inserted into an annular packing member 122 in a pressurized air supply port 121 provided to the cartridge holder.

Thus, the packing member 122 is closely contacted with and coupled to the outer peripheral surface of the cylindrical member 105, so that pressurized air can be introduced into the pressure chamber 25 of the ink cartridge.

According to the described construction, if the main tank is removed from the cartridge holder, the ink outlet plug 101 provided to the main tank is closed as shown in FIG. 9, so that ink can be prevented from leaking upon reception of the gravity. Further, concurrently, the ink reception connection plug 111 in the cartridge holder is also closed, so that backflow of ink from the sub-tank can be eliminated.

Second Embodiment

An example of a cover member arrangement will be described, which is applicable to a recording apparatus having the construction discussed in connection with the background art, the basic construction discussed above and/or the construction discussed in connection with the first embodiment, so as to constitute a recording apparatus of a second embodiment.

Figure 11:
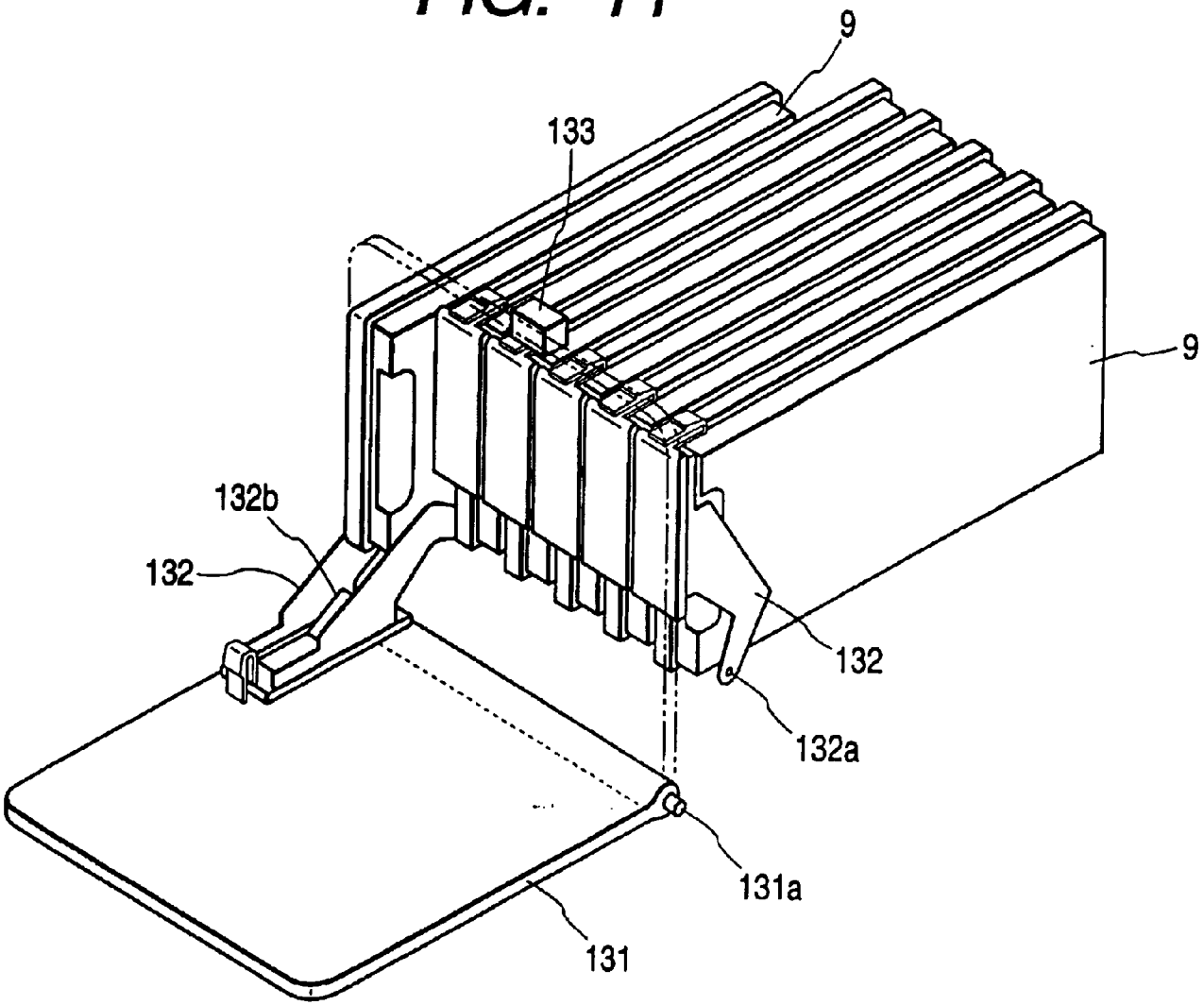
FIG. 11 is a perspective view to show a part of the configuration of the cartridge holder.

FIG. 11 shows a construction of a part of the cartridge holder 8. The cartridge holder 8 is provided with a cover member 131 that is opened when a main tank is mounted to or removed from the cartridge holder 8.

That is, the cover member 131 is disposed in front of an opening of the cartridge holder 8, and has a rotation shaft 131*a* supported by an unillustrated support hole formed in the recording apparatus main body. The cover member 131 is rotatable about an axis of the rotation shaft 131*a*, for opening the front opening of the cartridge holder 8 as indicated by the solid line, and closing the front opening of the cartridge holder 8 as indicated by the dash line.

In the cartridge holder 8 with the cover member 131 closed, a plurality of operation levers 132 are arranged in a one-to-one correspondence with the main tanks 9 mounted to the cartridge holder 8. A retention hole 132*a* is formed in the base end part of each operation lever 132, and an unillustrated support rod is passed through the retention holes 132*a* of the operation levers 132 to rotatably support the operation levers 132.

With the cover member 131 opened, the operation lever 132 can be rotated in the same direction as the open direction of the cover member 131, to enable mounting or removal of each main tank 9 from the cartridge holder 8.

That is, to mount the main tank 9 to the cartridge holder 8, after the operation lever 132 is rotated in the same direction as the open direction of the cover member 131, the main tank 9 is inserted into the cartridge holder 8, and then the operation lever 132 is set to an upright position, whereby a push part 132*b* formed on the operation lever 132 abuts the front end part of the main tank 9 and the main tank 9 is mounted to the holder 8 by leverage.

To remove the main tank 9 mounted to the holder 8, the operation lever 132 is rotated in the same direction as the open direction of the cover member 131 to push out the main tank 9 from the depth side mount position of the holder 8 using an unillustrated link rod engaged with a part of the operation lever 132.

Therefore, the main tank 9 pushed out in the front direction can be easily removed.

An electric switch 133 for detecting a open state of the cover member 131 is provided to the cartridge holder 8. As shown in FIG. 11, the electric switch is constructed, for example, by a contact switch which is contacted with the rear of the cover member 131 and turned on when the cover member 131 is closed, and turned off when the cover member 131 is open.

The switch 133 controls energizing of the electromagnetic plunger 91 provided to the pressure regulating valve 22 serving as the atmosphere release valve. That is, when the switch 133 is on, namely, the cover member 131 is closed, the electromagnetic plunger 91 can be energized, and when the switch 133 is off, namely, the cover member 131 is opened, energizing of the electromagnetic plunger 91 is shut off.

Therefore, when the operation power supply to the recording apparatus is input, for example, if a user attempts to remove the main tank 9 from the cartridge holder 8, energizing of the electromagnetic plunger 91 is shut off because the cover member 131 disposed on the cartridge holder 8 is opened.

Thus, the pressure regulating valve 22 also serving as the atmosphere release valve is opened, and pressurized air applied to the main tank placed in the cartridge holder is instantly released.

Therefore, the outer shell member of the ink cartridge slightly expanded upon reception of the action of the pressurized air is restored to the original shape. Consequently, the removal of the ink cartridge from the holder is facilitated, and the problem of damage to both the cartridge and the holder in association with the removing operation can also be eliminated.

The above-described embodiments are designed such that, in the case where the main tank 9 is removed from the cartridge holder 8, the pressure chamber 25 of the main tank is released into the atmosphere at the instant at which the cylindrical member 105 forming the pressurized air inlet port of the main tank is separated from the pressurized air supply port 121 of the cartridge holder 8.

Therefore, if the main tank 9 is removed from the cartridge holder 8, pressurizing the main tank is instantly canceled, and the disadvantage, such as splashing out of ink by the action of the remaining pressurized air, is avoided.

However, preferably the means for releasing the pressurized air based on the fact that the cover member 131 disposed on the cartridge holder 8 is opened as mentioned above is used together.

That is, at the instant at which the main tank 9 is being separated from the cartridge holder 8, there is a situation in which the ink outlet plug 101 in the main tank 9 is slightly away from the ink reception connection plug 111 in the cartridge holder 8 with the pressurized air applied. In this situation, the ink outlet plug 101 and the ink reception connection plug 111 are both in an open valve state.

Therefore, if the means for releasing the pressurized air in association with opening of the cover member 131 is not added, ink can splash out at the instant.

To adopt a main tank not adapted to open a pressurized air inlet formed in the main tank when the main tank is removed from the cartridge holder as mentioned above, it is extremely important to provide means for releasing pressurized air based on the fact that the cover member of the cartridge holder is opened.

It is desirable that driving the air pressurizing pump be stopped as the switch 133 is turned off based on opening of the cover member. This arrangement can eliminate meaningless idle running of the air pressurizing pump.

As can be understood from the foregoing description made, in a ink jet recording apparatus constructed according to the second embodiment, a cover member opened to enable attachment or detachment of an ink cartridge is provided to a cartridge holder, and atmosphere release means is provided for opening an air flow passage, extending from an air pressurizing pump to an ink cartridge, to the atmosphere as the cover member is opened. Accordingly, the removing operation of the ink cartridge from the cartridge holder can be facilitated, and the problem of damage to both the cartridge and the holder in the removing operation can also be eliminated.

Further, the problem of accidental splashing-out of ink from the ink cartridge can also be eliminated.

Third Embodiment

An example of a pressure regulating valve serving also as an atmosphere release valve will be described, which is applicable to a recording apparatus having the construction discussed in connection with the background art, the basic construction discussed above, the construction discussed in connection with the first embodiment, and/or the construction discussed in connection with the second embodiment, so as to constitute a recording apparatus of a third embodiment.

Figure 12:
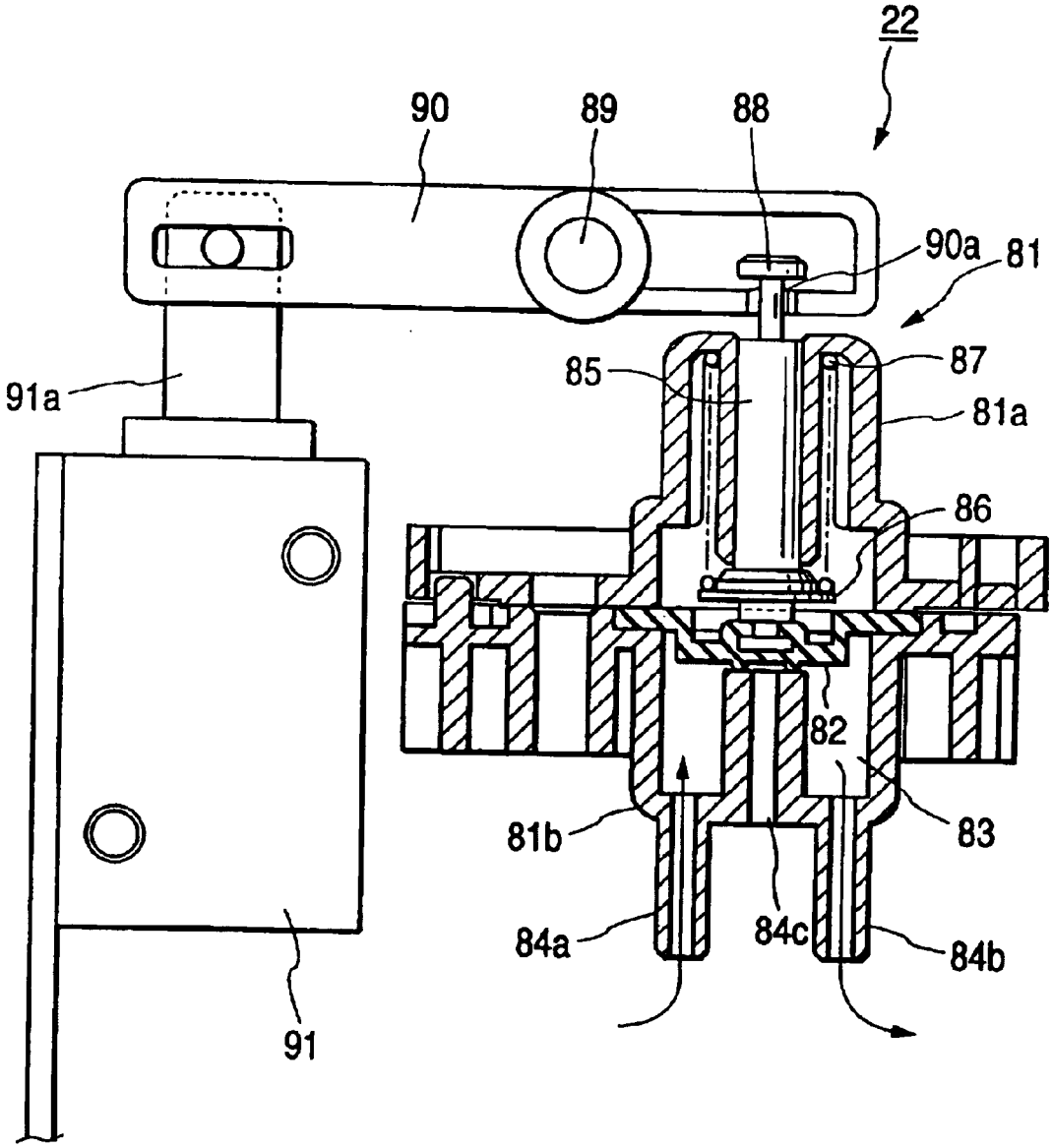
FIG. 12 shows another embodiment of on-off valve unit and is a partly sectional view to show a state in which the on-off valve unit functions as a pressure regulating valve.
Figure 13:
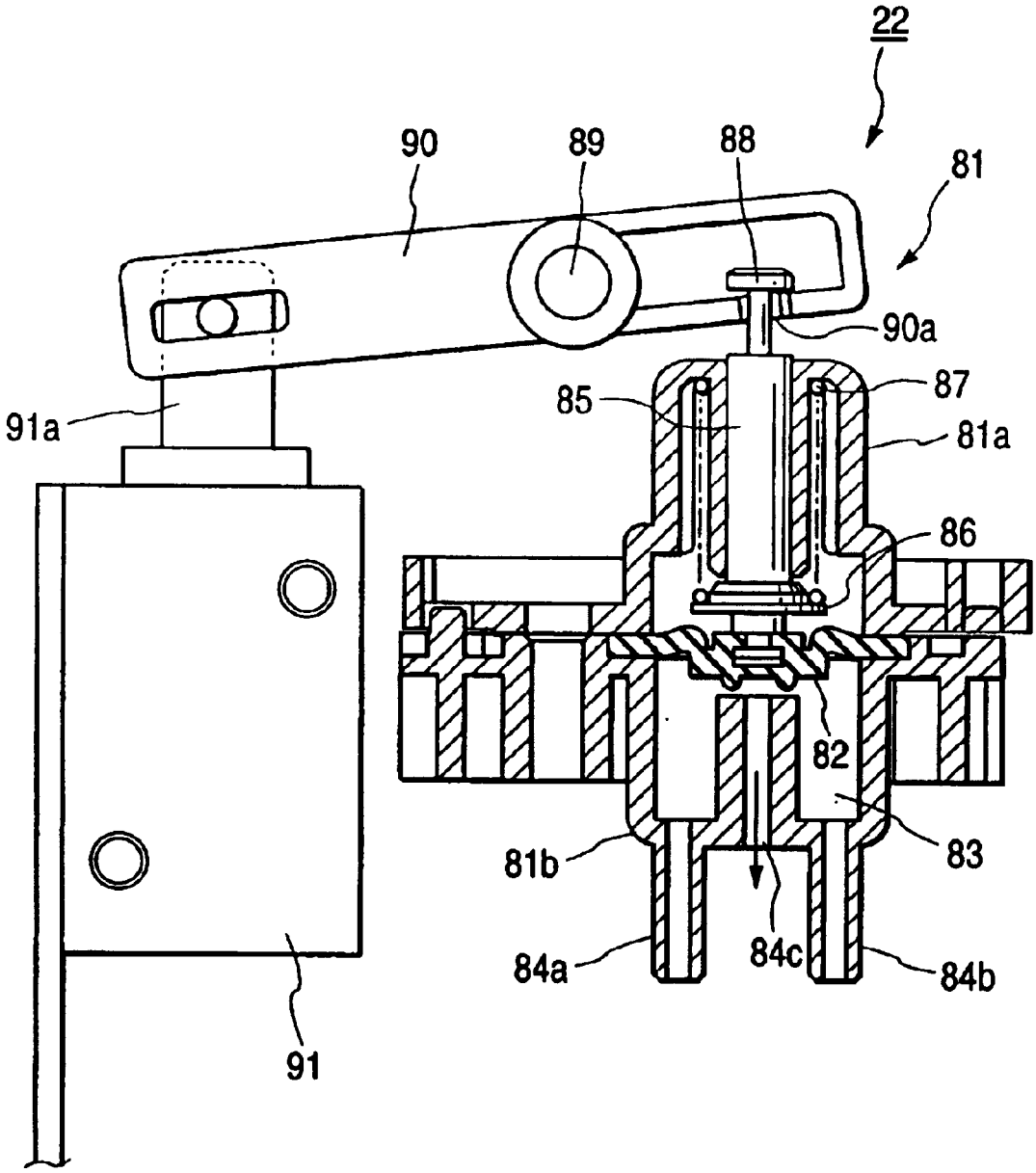
FIG. 13 is a partly sectional view to show an atmosphere release state in the on-off valve unit shown in FIG. 12.

FIGS. 12 and 13 are partly sectional views to show a second example of the pressure regulating valve 22 also serving as the atmosphere release valve with the main part in section. FIG. 12 shows a state in which the valve functions as the pressure regulating valve, and FIG. 13 shows an atmosphere release state.

An on-off valve unit 81 used in the present embodiment shown in FIGS. 12 and 13 has the same construction as the on-off valve unit 81 previously described with reference to FIGS. 7 and 8, and parts identical with or similar to those previously described with reference to FIGS. 7 and 8 are denoted by the same reference numerals in FIGS. 12 and 13 and will not be discussed again in detail.

In the example shown in FIGS. 12 and 13, a drive lever 90 is supported by a support shaft 89, and is rotated, like a seesaw, about the support shaft 89. An engagement head part 88 on the upper end part of a drive shaft 85 in the on-off valve unit 81 pierces through a through hole 90*a* formed in one end part of the drive lever 90 and is positioned above the through hole 90*a*.

An end part of an operational rod 91*a* of an electromagnetic plunger 91 as drive means is engaged with the opposite end part of the drive lever 90 with respect to the support shaft 89. Therefore, in this example, in a non-energization state in which the electromagnetic plunger 91 is not operated, the operational rod 91*a* is projected upwardly as shown in FIG. 12.

In this state in which the drive lever 90 has been rotated clockwise in the figure about the support shaft 89, the engagement head part 88 engaged with the one end part of the drive lever 90 is made to float (separate) from the one end part of the drive lever 90 as shown in FIG. 12. Thus, a diaphragm valve 82 is in a closed valve state of closing a ventilation hole 84*c* by the action of the urging force of a spring member 87 and the elastic force possessed by the diaphragm valve 82.

In this closed valve state, the air pressurizing pump 21 is driven, and if pressure in air chamber 83 exceeds a predetermined value, that is, exceeds the closed valve pressure produced by the urging force of the spring member 87 and the elastic force of the diaphragm valve 82, the diaphragm valve 82 is pushed up by the air pressure, whereby the contact of the diaphragm valve 82 with the ventilation hole 84*c* is released. Therefore, the pressurized air is derived from the air chamber 83 through the ventilation hole 84*c*, and pressure is released.

Thus, if the pressure of the pressurized air lowers to a given value, again the valve closing operation is performed by the closed valve pressure produced by the urging force of the spring member 87 and the elastic force of the diaphragm valve 82. Consequently, the pressure of the air flow passage from the air pressurizing pump 21 to the main tank 9 is controlled so as to fall within a predetermined range.

If the predetermined air pressure is thus exceeded in the non-energization state in which the electromagnetic plunger 91 is not operated, the diaphragm valve 82 functions as a pressure regulating valve repeatedly opened and closed.

The presence of the pressure regulating valve functioning as described above can eliminate a problem of, for example, breaking the ink pack in the main tank by abnormal air pressure caused by failure in control of the pressurized air.

On the other hand, the state shown in FIG. 13 is the atmosphere release state as mentioned above. The state is established by energizing the electromagnetic plunger 91. That is, the electromagnetic plunger 91 is energized, so that the operational rod 91*a* is attracted to the main unit side of the electromagnetic plunger 91.

Consequently, the drive lever 90 is rotated counterclockwise in the figure about the support shaft 89, and therefore the engagement head part 88 engaged with the one end part of the drive lever 90 is pulled upwardly as shown in FIG. 13.

Thus, the diaphragm valve 82 is opened against the urging force of the spring member 87 and the elastic force of the diaphragm valve 82, and the pressurized air is released through the ventilation hole 84*c* from the pressure chamber 83.

Preferably, the atmosphere release state shown in FIG. 13 is established when the operation power of the recording apparatus is turned off. This makes it possible to release the air pressure applied to the main tank 9 when the recording apparatus is not used, thereby eliminating the problem of, for example, inducing ink leakage from the main tank by the remaining air pressure during the non-operation state of the recording apparatus.

According to the example previously described with reference tot FIGS. 12 and 13, the electromagnetic plunger 91 need not always be energized during the normal operation of the recording apparatus. However, in the example previously described with reference to FIGS. 12 and 13, when the operation power of the recording apparatus is turned off, the electromagnetic plunger 91 as the drive means is also non-energized and thus a problem of making it impossible to realize the atmosphere release state occurs.

Therefore, it is desirable that the following control system be used together: If the power switch of the recording apparatus is turned off, a delay circuit is used to place a power supply circuit of the recording apparatus in an energization state over a predetermined time, and during this predetermined time period, the electromagnetic plunger 91 is energized for establishing the atmosphere release state, and after the delay circuit times out, the operation power of the recording apparatus is shut off.

If the operation power of the recording apparatus is turned off, it is desirable to control each ink replenishment valve 26 as ink replenishment control means to a closed valve state at the same time, and a problem of backflow of ink from each sub-tank 7 into each main tank 9 can be elimianted as ink replenishment valve 26 is closed.

In the example previously described with reference to FIGS. 12 and 13, the operational force of the electromagnetic plunger 91 as the drive means is transmitted to the on-off valve unit 81 via the drive lever 90 supported by the support shaft 89. However, the drive lever 90 may be dispensed with, as shown in FIG. 14.

Figure 14:
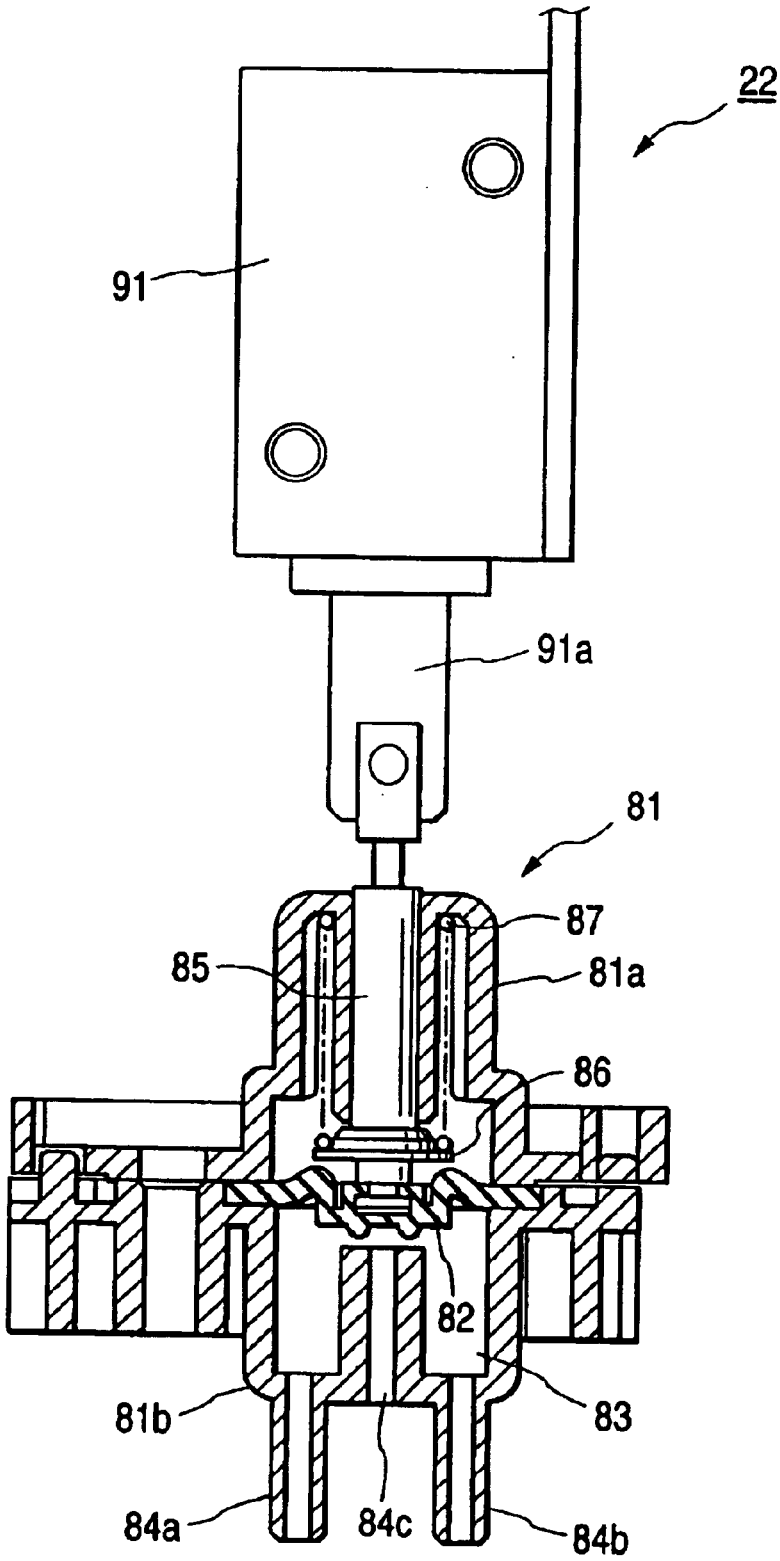
FIG. 14 is a partly sectional view to show still another embodiment of on-off valve unit.

That is, in an example shown in FIG. 14, the tip part of the drive shaft 85 in the on-off valve unit 81 is joined to the operational rod 91*a* of the electromagnetic plunger 91.

In the example shown in FIG. 14, a slight free stroke needs to be provided between the drive shaft 85 in the on-off valve unit 81 and the operational rod 91*a* of the electromagnetic plunger 91.

That is, with the slight free stroke provided therebetween, the on-off valve unit 81 properly functions as the pressure regulating valve such that the operational rod 91*a* of the electromagnetic plunger 91 permits a slight axial move of the drive shaft 85 of the on-off valve unit 81.

If the electromagnetic plunger 91 is energized, the drive shaft 85 of the on-off valve unit 81 is pulled up by the operational rod 91*a* to establish an atmosphere release state, similarly to the example previously described with reference tot FIGS. 12 and 13.

Figure 15:
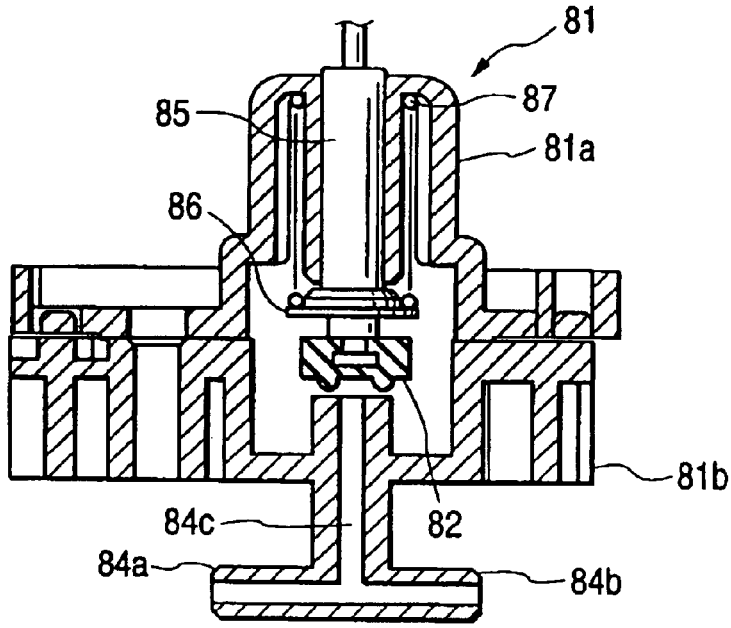
FIG. 15 is a sectional view to show still another embodiment of on-off valve unit.

FIGS. 15 are 16 are sectional views to show other examples of the pressure regulating valve also serving as the atmosphere release valve preferably used with the recording apparatus of the invention.

Figure 16:
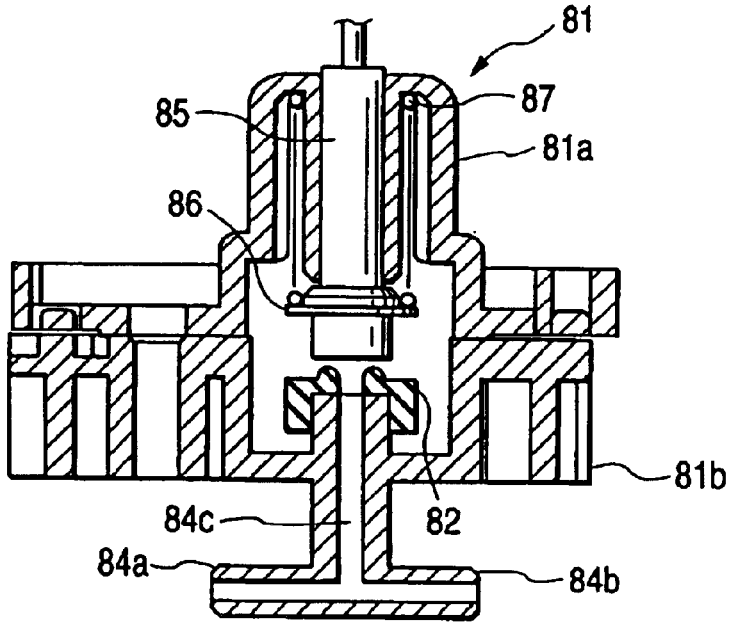
FIG. 16 is a sectional view to show still another embodiment of on-off valve unit.

FIGS. 15 and 16 show each only the construction of an on-off valve unit 81, and do not show the drive mechanism of an electromagnetic plunger. The drive mechanism of the electromagnetic plunger can adopt any of the constructions previously described with reference to FIGS. 7, 8, and 12 to 14 appropriately.

Parts identical with or similar to those previously described with reference to the accompanying drawings are denoted by the same reference numerals in FIGS. 15 and 16 and therefore will not be discussed again in detail.

In each of the examples shown in FIGS. 15 and 16, a pair of connection tubes 84*a* and 84*b* is formed so as to be communicated with a lower end part of a ventilation hole 84*c* formed in the center of a lower case 81*b*, and oriented in opposite directions therefrom.

In the example shown in FIG. 15, a valve member 82 molded of a rubber material is attached to a lower end part of a drive shaft 85.

The valve member 82 is urged so by a spring member 87 provided between a spring seat 86 and the space top part of an upper case 81a so that the valve member 82 abuts an opening end of the ventilation hole 84*c*.

With this arrangement, if the air pressure of an air flow passage from an air pressurizing pump to a main tank exceeds a predetermined value, the drive shaft 85 is pulled upwardly against the urging force of the spring member 87 and consequently, pressurized air is released into the space formed by the upper and lower cases 81*a* and 81*b*.

Although not shown in the figure, the upper and lower cases 81*a* and 81*b* are formed in part with an atmosphere release port, and therefore the pressurized air released into the space of the cases is immediately released into the atmosphere.

In the case where the drive mechanism of the electromagnetic plunger previously described with reference to FIGS. 12 to 14 is used in combination with the on-off valve unit 81 shown in FIG. 15, the valve member 82 is pulled upwardly by energizing the electromagnetic plunger, thereby establishing an atmosphere release state.

In the case where the drive mechanism of the electromagnetic plunger previously described with reference to FIGS. 7 and 8 is used in combination with the on-off valve unit 81 shown in FIG. 15, the non-energizing state of the electromagnetic plunger causes the valve member 82 to be pulled upwardly by the urging force of the tensile spring 93, thereby establishing an atmosphere release state similarly.

On the other hand, in the example shown in FIG. 16, a valve member 82 molded of a rubber material is attached to an opening end of a ventilation hole 84*c*. A lower end part of a drive shaft 85 is abutted against the valve member 82 by the urging force of a spring member 87 provided between a spring seat 86 and the space top part of an upper case 81*a*.

With this arrangement, if the air pressure of an air flow passage from an air pressurizing pump to a main tank exceeds a predetermined value, the drive shaft 85 is pulled upwardly by the air pressure and consequently, pressurized air is released into the space formed by upper and lower cases 81*a* and 81*b*.

Although not shown in FIG. 16 either, the upper and lower cases 81*a* and 81*b* are formed in part with an atmosphere release port so that the pressurized air released into the space of the cases is immediately released into the atmosphere.

In the case where the drive mechanism of the electromagnetic plunger previously described with reference to FIGS. 12 to 14 is used in combination with the on-off valve unit 81 shown in FIG. 16, the electromagnetic plunger is energized to upwardly pull the drive shaft 85, thereby establishing an atmosphere release state.

In the case where the drive mechanism of the electromagnetic plunger previously described with reference to FIGS. 7 and 8 is used in combination with the on-off valve unit 81 shown in FIG. 16, the non-energizing state of the electromagnetic plunger causes the drive shaft 85 to be pulled upwardly by the urging force of the tensile spring 93, thereby establishing an atmosphere release state similarly.

In the examples previously described with reference to FIGS. 7, 8, and 12 to 14, the ventilation hole 84*c* is closed to establish a closed valve state using the elastic force of the valve member 82 and the urging force of the spring member 87, whereas in the examples previously described with reference to FIGS. 15 and 16, the ventilation hole 84*c* is closed to establish a closed valve state using only the urging force of the spring member 87. However, the ventilation hole can also be closed to establish a closed valve state using only the elastic force of the valve member, if such an arrangement is required.

This arrangement can be realized, for example, such that the spring member 87 in each of the examples previously described with reference to FIGS. 7, 8, and 12 to 14 is removed, and only the diaphragm valve 82 is used as the valve member for closing the ventilation hole 84*c* by the elastic force of the diaphragm valve 82.

As can be understood from the forgoing description, an ink jet recording apparatus constructed according to the third embodiment of the invention has an on-off valve unit having a valve member that is provided to an air flow passage from an air pressurizing pump to a main tank and that is opened under a given or more air pressure for maintaining the air pressure in the air flow passage in a predetermined range, and a drive system capable of forcibly opening the valve member of the on-off valve unit to release or cancel a pressurization state of the air pressurizing pump. Thus, the air pressure in the appropriate range is constantly applied to each main tank by the pressure regulating function during the operation of the recording apparatus, whereby each sub-tank can be stably replenished with ink from each main tank.

The atmosphere release function can be used to forcibly release the air pressure to the main tank. Thus, the atmosphere release function is activated, for example, when the operation power of the recording apparatus is turned off, thereby making it possible to eliminate a problems of, for example, inducing ink leakage from the main tank during the non-operation state of the recording apparatus.

Further, the valve member in the on-off valve unit serves to provide both the pressure regulating function and the atmosphere release function, so that the occupation volume in the recording apparatus can be lessened and the product costs can be decreased as compared with a construction in which the pressure regulating function and the atmosphere release function are provided separately.

Fourth Embodiment

An example of a pressure detector will be described, which is applicable to a recording apparatus having the construction discussed in connection with the background art, the basic construction discussed above, the construction discussed in connection with the first embodiment, the construction discussed in connection with the second embodiment, and/or the construction discussed in connection with the third embodiment, so as to constitute a recording apparatus of a fourth embodiment.

Figure 17:
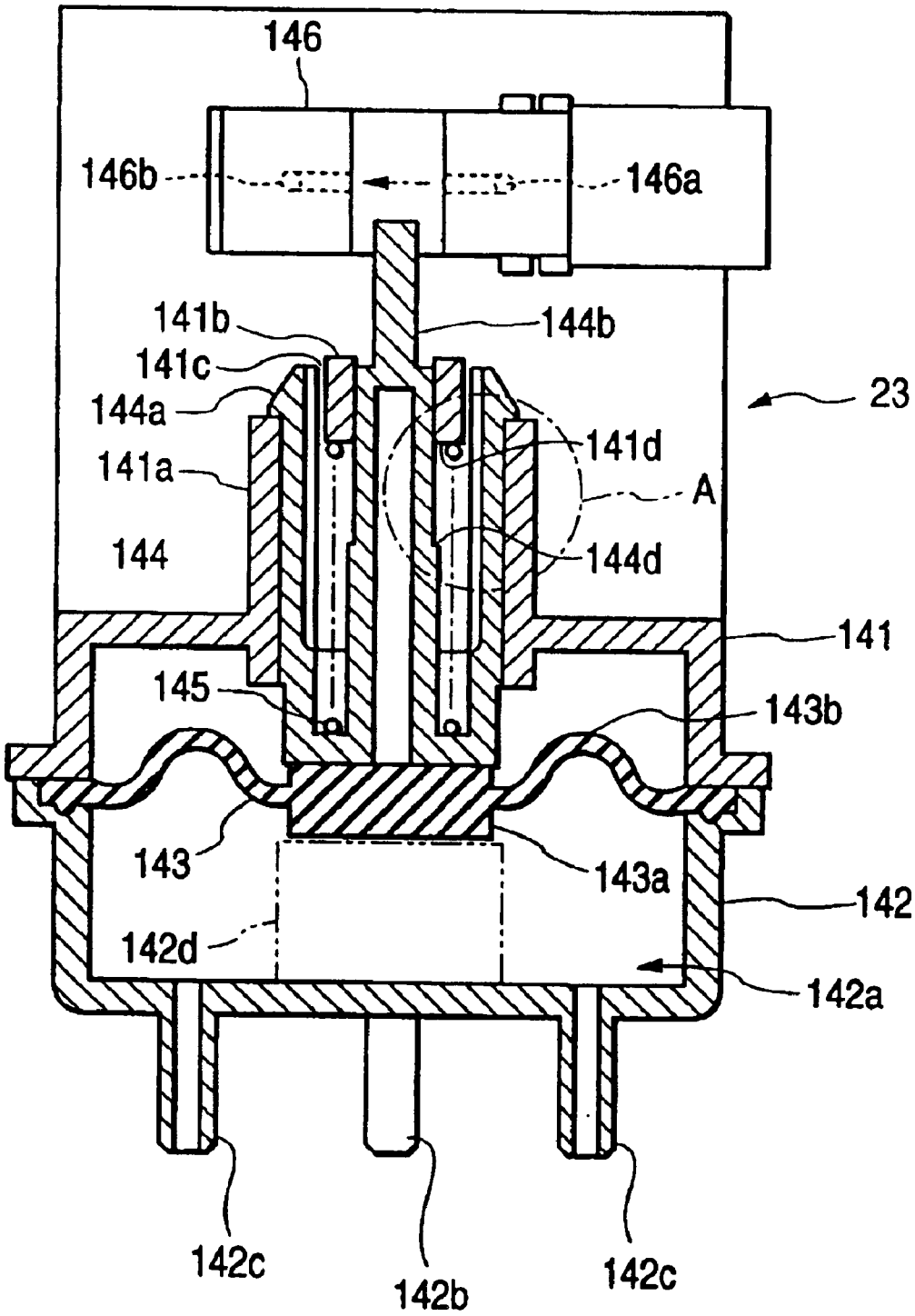
FIG. 17 is a sectional view to show a first embodiment of a pressure detector used in the ink supply system shown in FIG. 2.

FIG. 17 is a sectional view to show a first example of a pressure detector used with the ink jet recording apparatus according to the invention. The pressure detector 23 includes an upper case 141 whose outside shape is formed like a cylinder and a lower case 142 whose outside shape is formed like a cylinder. A diaphragm 143 formed of a flexible elastic member in a disk shape is arranged such that a peripheral portion thereof is clamped between the upper case 141 and the lower case 142.

As shown in FIG. 17, the diaphragm 143 is formed at the center with a thick portion 143*a*, and a thin portion 143*b* semicircular in cross section is formed between the thick portion 143*a* and the peripheral portion. Preferably, the diaphragm 143 is made of a rubber material. The diaphragm 143 maybe formed as a cloth filled or impregnated with a rubber material, in which case the durability of the diaphragm can be enhanced.

On the other hand, a cylindrical body 141*a* is formed integrally on the top of the upper case 141. An inner cylindrical body 141*b* integral with the cylindrical body 141*a* is located on the top of the inside of the cylindrical body 141*a*. In the cross-sectional state shown in FIG. 17, the inner cylindrical body 141*b* is illustrated as being separated from the cylindrical body 141*a*, but, in fact, the inner cylindrical body 141*b* is joined to the cylindrical body 141a at circumferential positions opposite to each other in a direction orthogonal to the paper surface of FIG. 17. In other words, a pair of opening parts 141*c* as shown in FIG. 17 are formed between the cylindrical body 141*a* and the inner cylindrical body 141*b* to be confronted with each other.

A movable member 144 is accommodated in the interior of the cylindrical body 141*a* so that the movable member 144 can slide in an axial direction (up and down direction in FIG. 17). The movable member 144 is formed like a forked shape, and a stopper member 144a shaped like a claw is formed at each tip part of the movable member 144*a*. These stopper members 144*a* respectively enters the opening parts 141*c* to engage the upper end part of the cylindrical body 141*a*.

The movable member 144 is formed with an upright part 144*b* integral with and projecting from the inner bottom part of the movable member 144. In the example shown in FIG. 17, a coiled spring member 145 is disposed between the lower end part of the inner cylindrical body 141*b* and the inner bottom part of the movable member 144 to surround the upright part 144*b*.

With this arrangement, the movable member 144 is urged in the down direction in the figure by the spring member 145, whereby the lower bottom part of the movable member 144 abuts the top face of the thick portion 143*a* at the center of the diaphragm 143.

On the other hand, the lower case 142 is formed at the lower bottom with a pressurized air introduction connection tube 142*b* for introducing pressurized air from the air pressurizing pump 21 into a space portion 142*a* between the lower case 142 and the diaphragm 143, and a plurality of pressurized air distribution connection tubes 142*c* for distributing the pressurized air to the main tanks 9 from the space portion 142*a*.

In this example, four main tanks 9 are provided as mentioned above and in this case, four pressurized air distribution connection tubes 142*c* are provided corresponding to the number of the main tanks. FIG. 17 shows two pressurized air distribution connection tubes 142*c* because it is a sectional view.

With this arrangement, the pressurized air from the air pressurizing pump 21 is introduced into the space portion 142*a* of the pressure detector 23 through the pressurized air introduction connection tube 142*b* and then is applied through the pressurized air distribution connection tubes 142*c* to the pressure chambers 25 of the corresponding main tanks 9.

Upon reception of the action of the pressurized air introduced into the space portion 142*a*, the diaphragm 143 is displaced in the upward direction in the figure, pushing the movable member 144 upwardly. The space portion formed between the diaphragm 143 and the upper case 141 communicates with the atmosphere via a gap between the cylindrical body 141*a* and the movable member 144.

In this example, the movable member 144 is urged in the down direction in the figure by the spring member 145 as mentioned above, and therefore the movable member 144 is moved up and down based on the displacement of the diaphragm 143 caused by balance of the air pressure received by the diaphragm 143, the restoration force produced by the elasticity of the diaphragm, and the urging force of the spring member 145.

On the other hand, a photosensor 146 constructing output generation means is placed on the moving path of the tip of the upright part 144*b* provided to the movable member 144.

The photosensor 146 includes a light source 146*a* and a light receiving element 146*b* disposed facing each other. Therefore, if the diaphragm 143 is displaced exceeding a predetermined amount upon reception of the pressurized air introduced into the space portion 142*a*, the tip part of the upright part 144*b* of the movable member 144 blocks the optical axis of the photosensor 146 extending from the light source 146*a* to the light receiving element 146*b*.

Therefore, if the air pressurizing pump 21 is driven and the pressurized air reaches a predetermined pressure or more, the diaphragm is displaced, pushing up the upright part 144*b* for blocking the optical axis of the photosensor 146, so that the air pressurizing pump 21 is stopped based on the output of the light receiving element 146*b* at the time.

If the air pressure lowers with consumption of ink, etc., the tip part of the upright part 144*b* of the moving member 144 is away from the optical axis of the light source 146*a* and the light receiving element 146*b* by the restoration force produced by the elasticity of the diaphragm and the urging force of the spring member 145.

Thus, the light receiving element 146*b* generates output, and a control signal to drive the air pressurizing pump 21 is generated based on the output.

In this case, the control signal based on the output of the light receiving element 146*b* forming a part of the photosensor maybe used to drive or stop a motor (not shown) directly connected to the air pressurizing pump 21, for example. In the case where a motor for driving any other mechanism unit is commonly used to drive the air pressurizing pump 21, the control signal can be used to control the engagement of a clutch mechanism (not shown) provided to a drive system between the pump 21 and the motor.

The movable member 144 is formed with a step part 144*d* for preventing the diaphragm 143 from being excessively displaced upon reception of pressurized air, as indicated by A portion in FIG. 17.

Figure 18:
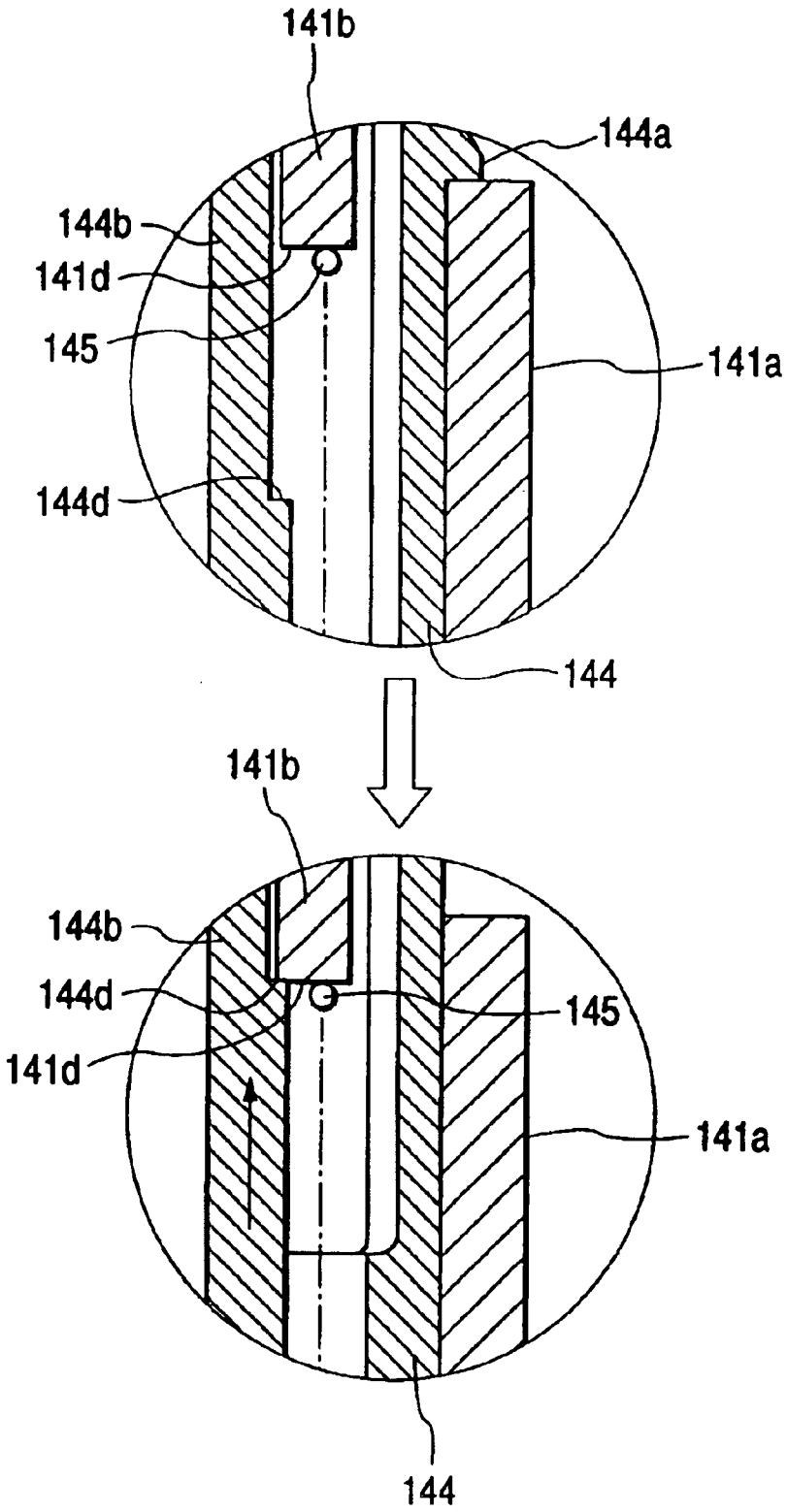
FIG. 18 is a sectional view to show, on an enlarged scale, the configuration of a part of the pressure detector shown in FIG. 17.

To describe the construction and the function of this arrangement, the portion A in FIG. 17 is shown in an enlarged manner in FIG. 18.

That is, the upper-half drawing of FIG. 18 shows a state in which the diaphragm receives a normal or less air pressure, and the lower-half drawing of FIG. 18 shows a state in which the diaphragm receives a predetermined or more air pressure.

If the diaphragm changes from the state in which the diaphragm receives the normal or less air pressure to the state in which the diaphragm receives the predetermined or more air pressure as shown in FIG. 18, the movable member 144 moves in the up direction in the figure, and the step part 144*d* on the upright part 144*b* integral with and projecting from the inner bottom part of the movable member 144 abuts an abutment part 144*d* forming the lower end part of the inner cylindrical body 141*b*, thereby inhibiting a further upward movement of the movable member 144.

Thus; excessive displacement of the diaphragm 143*b* can be avoided and the normal function of the pressure detector 23 can be guaranteed.

In the example shown in FIG. 17, the movable member 144 is formed like a forked shape, and the stopper member 144*a* shaped like a claw is formed at each tip part of the forked shape, and thus the stopper members 144*a* engage the upper end part of the cylindrical body 141*a*, whereby the diaphragm 143 is prevented from being excessively displaced by the spring member 145.

However, if the stopper member 144*a* shaped like a claw is not formed, it is desirable that a cylindrical stopper member 142*d* be molded integrally on the center of the lower bottom of the lower case 142 as indicated by the phantom line in FIG. 17, thereby preventing excessive displacement of the diaphragm.

Figure 19:
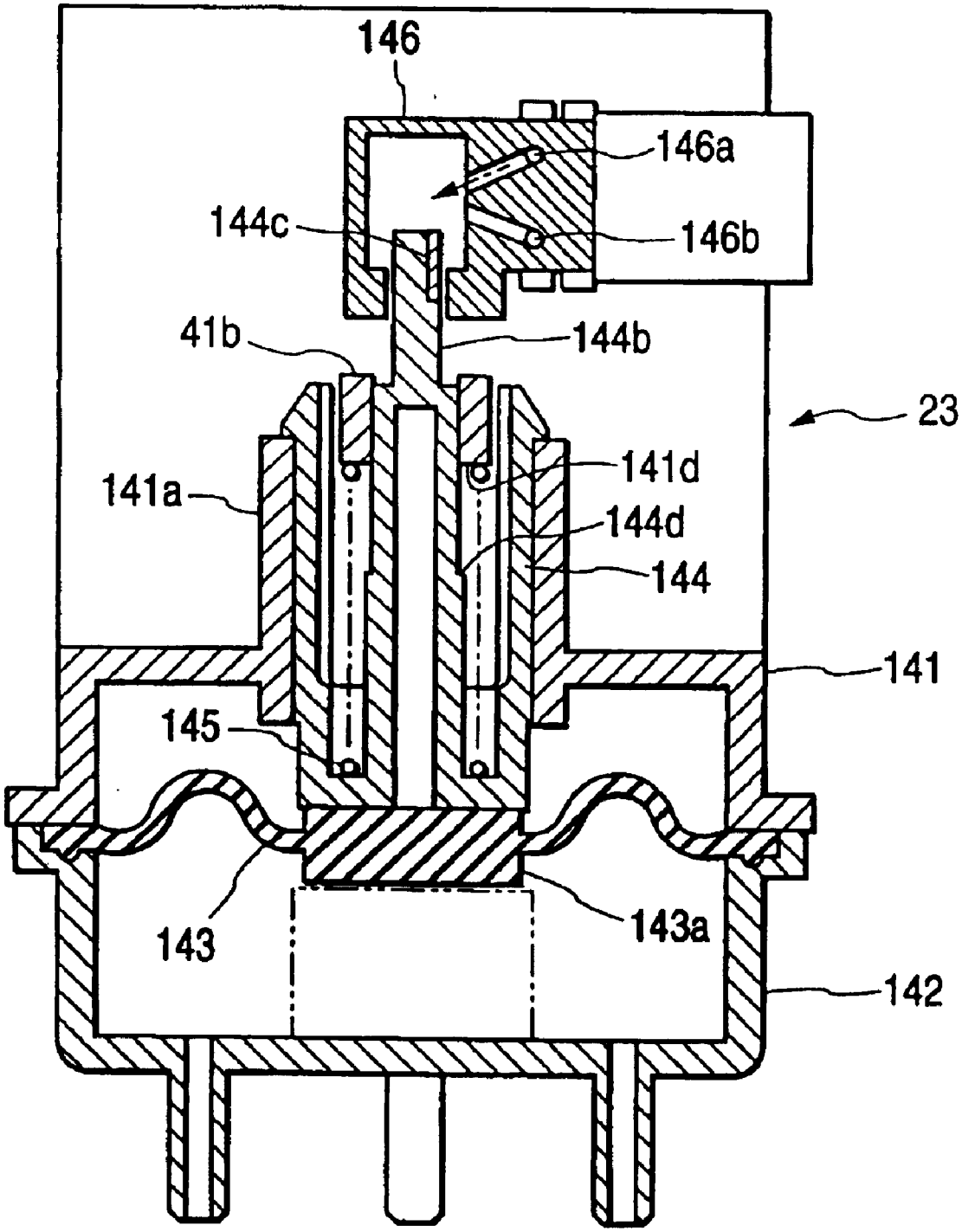
FIG. 19 is a sectional view to show a second embodiment of pressure detector.

Next, FIG. 19 is a sectional view to show a second example of pressure detector. The pressure detector 23 shown in FIG. 19 has a similar configuration to that of the pressure detector previously described with reference to FIGS. 17 and 18 except for photosensor 146. Therefore, representative parts identical with or similar to those previously described with reference to FIGS. 17 and 18 are denoted by the same reference numerals in FIG. 19 and will not be discussed again in detail.

In the example shown in FIG. 19, the photosensor 146 is made up of a light source 146*a* for projecting light onto the moving path of an upright part 144*b* of a movable member and a light receiving element 146*b* for receiving reflected light of the light source caused based on a movement of the upright part 144*b*.

Therefore, in this arrangement, it is desirable that a white synthetic resin material having an excellent reflection characteristic be used to form the upright part 144*b* or that a reflection member 144*c* formed of, for example, aluminum foil, etc., be attached to the upright part 144*b* at position corresponding to the path of projected light in the light source 146*a*.

According to the arrangement shown in FIG. 19, if the air pressurizing pump 21 is driven and the pressurized air reaches a predetermined pressure or more, a diaphragm 143 is displaced, pushing up the upright part 144*b* of the movable member and the tip of the upright part 144*b* or the reflection member 144*c* provided to the upright part 144*b* receives projected light from the light source 146*a* and reflects the light onto the light receiving element 146*b*.

A control signal to stop driving the air pressurizing pump 21 is generated based on the output of the light receiving element 146*b*.

If the air pressure lowers with consumption of ink, etc., the tip part of the upright part 144*b* of the movable member 144 is away from the optical axis of the light source 146*a* by the restoration force produced by the elasticity of the diaphragm and the urging force of a spring member 145.

Thus, the reflected light is not projected onto the light receiving element 146*b*, and a control signal to drive the air pressurizing pump 21 is generated.

In each of the examples of the pressure detectors 23 previously described with reference to FIGS. 17 to 19, a coiled spring member 145 is disposed between the lower end part of the inner cylindrical body 141*b* formed in the upper case 141 and the inner bottom of the movable member 144 so as to surround the upright part 144*b*.

However, a pressure detector 23 having the similar function can also be constructed without the use of the spring member 145. In this case, the movable member 144 advances or retreats based on the displacement of the diaphragm 143 caused by balance of the restoration force of the diaphragm 143 formed of an elastic material and the air pressure received by the diaphragm 143.

Therefore, to adopt such a construction, the lower bottom of the movable member 144 needs to be bonded to the top face of the thick portion 143*a* of the diaphragm 143, or the thick portion 143*a* of the diaphragm 143 needs to be molded integrally with the lower bottom of the movable member 144. That is, the movable member 144 and the thick portion 143*a* of the diaphragm 143 are required to be mechanically connected to each other.

As can be seen in the foregoing description, in an ink jet recording apparatus constructed according the fourth embodiment, a pressure detector for detecting pressure of pressurized air is provided to an air flow passage extending between an air pressurizing pump and a main tank, and the air pressurizing pump is controlled based on a control signal generated depending on the pressure detected by the pressure detector.

Therefore, it is also made possible to solve problems of noise and durability caused by driving the air pressurizing pump all the time.

In addition, the pressure detector is constructed to have a diaphragm displaced upon reception of the air pressure of pressurized air, and an output generation system for generating the control signal based on the displacement amount of the diaphragm. Therefore, the air pressurizing pump can be controlled with a comparatively simple construction, thus contributing to an improvement in operation reliability of the ink jet recording apparatus of this type.

Fifth Embodiment

An example of a control system or method will be described with reference to FIG. 20, which is applicable to a recording apparatus having the construction discussed in connection with the background art, the basic construction discussed above, the construction discussed in connection with the first embodiment, the construction discussed in connection with the second embodiment, the construction discussed in connection with the third embodiment, and/or the construction discussed in connection with the fourth embodiment, so as to constitute a recording apparatus of a fifth embodiment.

If the pressure detector 23 constructed as described above is used to control driving of the air pressurizing pump, the following operation is repeated frequently: If consumption of ink in the main tank advances even a little based on the print operation, etc., the pressure detector detects pressure less than a predetermined pressure and drives the air pressurizing pump, and if the air pressurizing pump is driven for a short while, the pressure detector detects the predetermined pressure and stops driving the air pressurizing pump.

Figure 20:
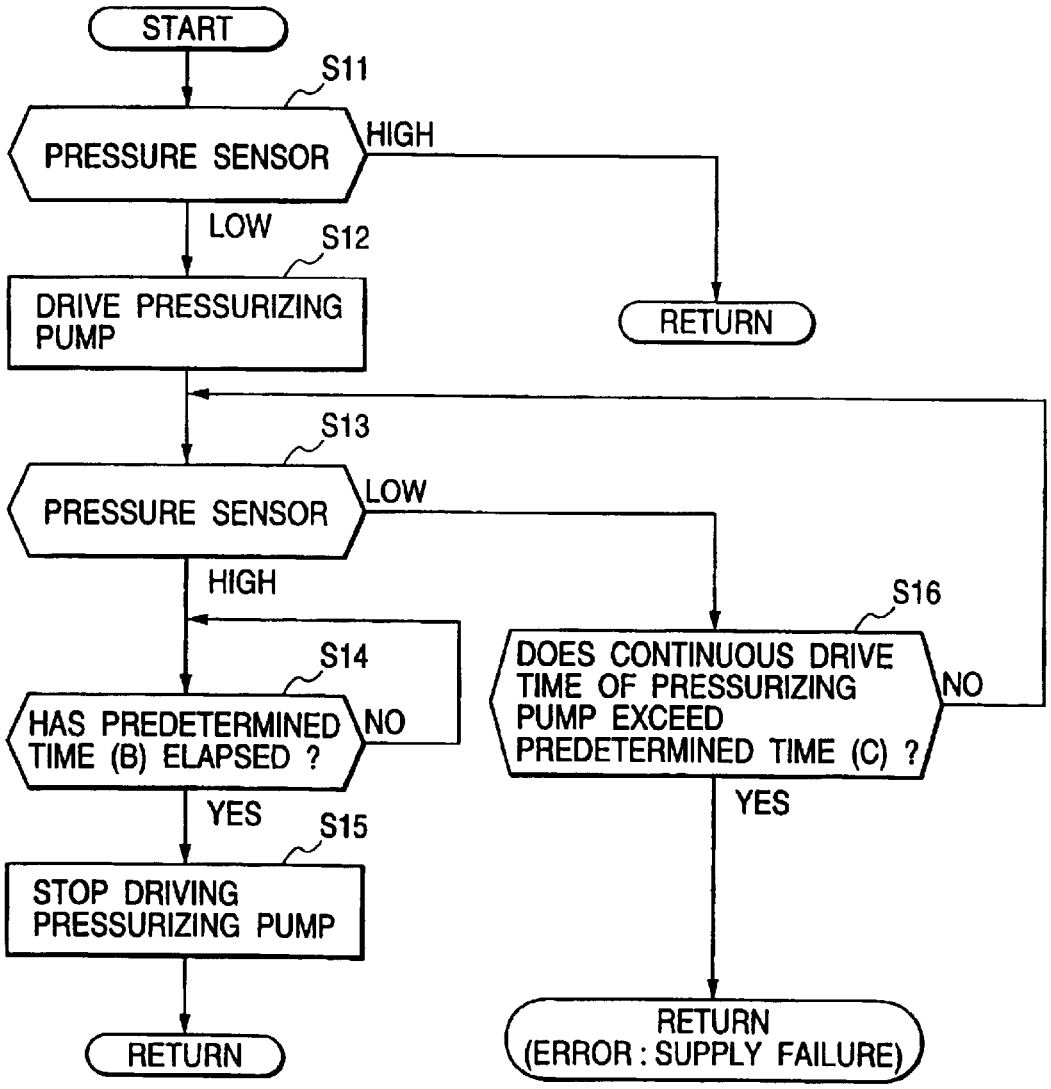
FIG. 20 is a flowchart to show a control routine to control driving an air pressurizing pump using output of the pressure detector.

FIG. 20 shows an operation routine of a drive control system for the air pressurizing pump in order to prevent such frequently repetitive operation.

At step S11, the above-mentioned electric output of a pressure sensor serving as the pressure detector 23 is checked. If it is determined at step S11 that the pressure detection value of the pressure sensor does not reach a predetermined pressure (low), the control program advances to step S12, and the pressurizing pump 21 is driven.

In the drive state of the pressurizing pump, at step S13, the above-mentioned electric output of the pressure sensor is checked, and if it is determined that the pressure detection value reaches the predetermined pressure (high), the control program advances to step S14, and whether or not a predetermined time (B) has elapsed since a time point at which the pressure detection value reached the predetermine pressure. When it is determined that the predetermined time (B) has elapsed, the control program advances to step S15, and driving the pressurizing pump 21 is stopped.

According to this operation, air pressure sufficiently exceeding the predetermined pressure detected by the pressure sensor is accumulated in the air flow passage from the pressurizing pump 21 to each main tank 9.

The control program returns to step S11, and the above-mentioned electric output of the pressure sensor is checked. In this case, air pressure sufficiently exceeding the predetermined pressure detected by the pressure sensor is accumulated in the air flow passage from the pressurizing pump 21 to-each main tank 9, and thus the electric output is determined high, and control returns to the step S11.

At step S11, checking the electric output of the pressure sensor is continued all the time, and if it is determined that the pressure detection value falls below the predetermined pressure (low) as ink is consumed by the print operation, for example, the operation at step S12 and the subsequent operations are executed as described above.

At step S12, driving the pressurizing pump is started, and if it is determined at step S13 that the check result of the pressure sensor does not reach the predetermined pressure (low), the control program advances to step S16, and the continuous drive time of the pressurizing pump is checked.

At step S16, whether or not the continuous drive time of the pressurizing pump exceeds a predetermined time (C) is checked. If it is determined that the continuous drive time of the pressurizing pump exceeds the predetermined time (C) (Yes) with the pressure detection state remaining low at step S13, it can be assumed that some fault occurs in the pressurized air supply system.

In this case, for example, an error message, etc., indicating a supply failure is displayed on a display (not shown) provided to the recording apparatus.

At step S14, whether or not the predetermined time (B) has elapsed is determined, and when the predetermined time (B) has elapsed, the control program advances to step S15, and driving the pressurizing pump 21 is stopped. However, for example, the substantial volume of the pressure chamber 25 varies depending on whether the amount of ink in each main tank 9 as an ink cartridge is in an ink full state or in a near ink end state, and thus the pressure of pressurized air varies depending on whether the ink amount is in the ink full state or in the near ink end state.

If this variation causes a problem, a sufficient time, by which the pressure release valve 22 is activated to be open, is set as the predetermined time (B) used when whether or not the predetermined time (B) has elapsed is determined at step S14.

If such control means is adopted, the function of the pressure release valve 22 described above can be used positively, and as the pressurizing pump 21 is driven, the pressure release valve 22 can be opened for releasing excessive pressure.

If driving the pressurizing pump 21 is stopped, the pressurized air raised to pressure just before the pressure release valve 22 is opened can be accumulated in the air flow passage.

By adopting the described operation sequence, a sufficient air pressure can be accumulated with one drive operation of the pressurizing pump 21.

Therefore, a considerable time interval is provided between the time the pressure sensor detects a low condition and the time the pressurizing pump 21 is again driven as the air pressure lowers because of ink consumption, etc., and the frequently repetitive operation of driving and stopping the pressurizing pump 21 can be suppressed.

As can be seen in the forgoing description, an ink jet recording apparatus constructed according to the fifth embodiment of the invention includes a control system which drives an air pressurizing pump if a pressure detection value obtained by a pressure detector does not reach a predetermined pressure value, and which stops the air pressurizing pump after expiration of a predetermined time if the pressure detection value obtained by the pressure detector reaches the predetermined pressure value. Accordingly, the problem of the frequently repetitive operation of driving and stopping the pressurizing pump can be solved.

Sixth Embodiment

An example of a system that can maintain an ink flow velocity regardless of temperature change will be described. The system is applicable to a recording apparatus having the construction discussed in connection with the background art, the basic construction discussed above, the construction discussed in connection with the first embodiment, the construction discussed in connection with the second embodiment, the construction discussed in connection with the third embodiment, the construction discussed in connection with the fourth embodiment, and/or the construction discussed in connection with the fifth embodiment, so as to constitute a recording apparatus of a fifth embodiment.

Ink with which the sub-tank is replenished from the main tank has such a temperature dependency characteristic that viscosity changes with environmental temperature, as mentioned above. That is, when the environmental temperature is low, the viscosity of the ink is high, and as the environmental temperature becomes higher, the viscosity of the ink is lowered. Therefore, the ink replenishment flow velocity to the sub-tank from the main tank becomes higher with a rise in the temperature.

In a recording apparatus adopting such a configuration that the sub-tank is replenished with ink from the main tank as mentioned above, it is desired that the ink replenishment flow velocity to the sub-tank from the main tank should be suppressed to a given range independently of the environmental temperature. In this case, it is made possible to suppress change in the ink replenishment flow velocity to the sub-tank from the main tank within a predetermined range by controlling and changing the setup pressure of the pressurized air applied to the main tank in response to change in the temperature.

For this reason, it is desirable that the diaphragm 143 used in the pressure detector 23 be formed of a material having such varying hardness as to be high in a low temperature state and low in a high temperature state.

As the material having such a function, the diaphragm 143 uses rubber material as mentioned above. Preferably, the rubber material is NBR and has a rubber hardness of 40 to 60 degrees.

The diaphragm 143 may be formed of a cloth filled with rubber material, in which case the durability of the diaphragm can be enhanced.

Figure 21:
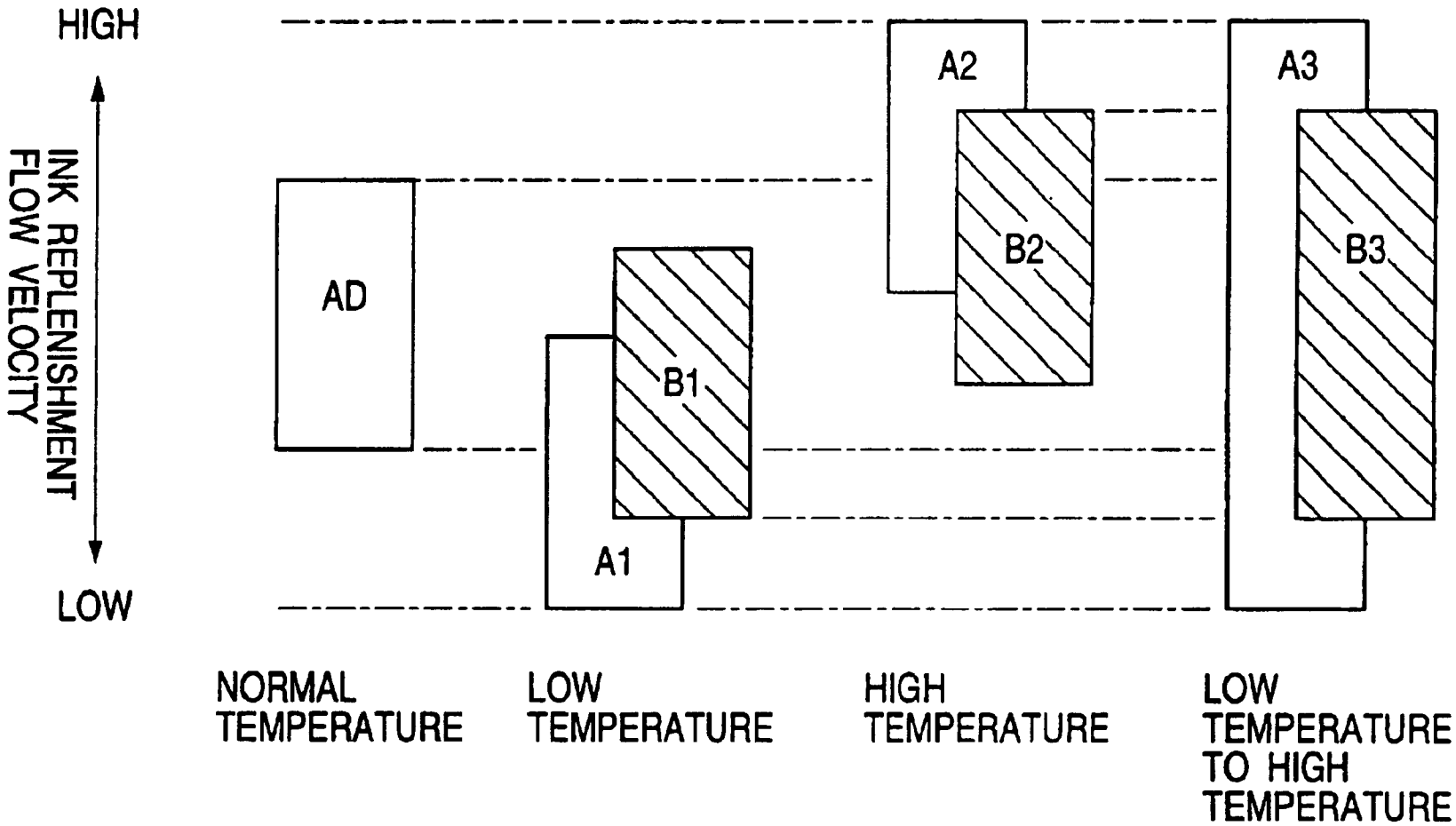
FIG. 21 is a drawing to show the relationship between the environmental temperature and the ink replenishment flow velocity when a diaphragm uses a material having a temperature characteristic.

FIG. 21 shows the relationship between the environmental temperature and the ink replenishment flow velocity when the diaphragm 143 in the pressure detector 23 uses a material having a temperature characteristic.

The area shown as A0 in FIG. 21 indicates the ink replenishment flow velocity when ink is supplied from the main tank to the sub-tank at room temperature (25° C.). The flow velocity has the width A0 meaning the range of variations caused by the diaphragm forming a part of components of the pressure detector 23, and assembly of these components. If the environmental temperature lowers, the ink replenishment flow velocity becomes low as mentioned above, as indicated by A1.

The diaphragm 143 forming a part of the pressure detector 23 uses a material having hardness becoming high in a low temperature state. Therefore, in the low temperature state, the displacement of the diaphragm for driving the movable member 144 is suppressed, so that the value of pressure when the photosensor 146 detects the move state of the movable member becomes high.

Consequently, driving the air pressurizing pump 21 is continued, thereby increasing the flow velocity of ink with which the sub-tank 7 is replenished from the main tank 9. That is, in this case, the ink replenishment flow velocity is shifted from A1 to the range of B1.

On the other hand, if the environmental temperature rises, the ink replenishment flow velocity becomes high as indicated by A2. The diaphragm 143 forming a part of the pressure detector 23 uses a material having hardness changed so as to become low in a high temperature state. Therefore, driving the movable member 144 as the diaphragm is displaced is promoted in the high temperature state, and the value of pressure when the photosensor 146 detects the move state of the movable member becomes low.

Consequently, driving the air pressurizing pump 21 is stopped at an early stage, thereby decreasing the flow velocity of ink with which the sub-tank 7 is replenished from the main tank 9. That is, in this case, the ink replenishment flow velocity is shifted from A2 to the range of B2.

If the environmental temperature changes from the low temperature state to the high temperature state and vice versa, the ink replenishment flow velocity is shifted from A3 to the range of B3 as a result of the function described above.

In other words, the range of variations occurring caused by the diaphragm 143 forming a part of components of the pressure detector 23 and their assembling is reduced.

In the above-described example, the air pressure applied to the pressure chamber 25 in the main tank must be set so that the lower limit of the ink replenishment flow velocity becomes a velocity equal to or more than the amount of ink ejected through the record head 6. As shown in FIG. 21, the ink replenishment flow velocity is shifted to the range of B3, and consequently the value of the lower limit becomes high, so that if the setup pressure of the air pressure applied to the pressure chamber 25 is lowered, a margin is left on the operation.

Therefore, the setup pressure of the air pressure applied to the pressure chamber 25 in the main tank can be made lower, contributing to improving the function of the pressurizing pump 21 and the reliability of the components forming the air flow passage from the pressurizing pump 21 to the main tank.

The description has been made based on the diaphragm 143 using the material having hardness changed so as to become high in a low temperature state and low in a high temperature state. However, similar advantages can be obtained if the diaphragm 143 is formed of a material having a volume changed so as to contract in a low temperature state and expand in a high temperature state.

That is, in this case, in the low temperature state, the diaphragm 143 contracts to substantially shift the upright part 144b of the movable member 144 away from the sensible area of the photosensor 146. Accordingly, the value of pressure when the photosensor 146 detects the move state of the moving member becomes high.

Therefore, driving the air pressurizing pump is continued, thereby increasing the flow velocity of ink with which the sub-tank is replenished from the main tank.

On the other hand, in the high temperature state, the diaphragm 143 expands to substantially shift the upright part 144*b* of the movable member 144 toward the sensible area of the photosensor 146. Accordingly, the value of pressure when the photosensor 146 detects the move state of the moving member becomes low.

Therefore, driving the air pressurizing pump is stopped at an early stage, thereby decreasing the flow velocity of ink with which the sub-tank is replenished from the main tank. Thus, the ink replenishment flow velocity is shifted from the range of A3 to the range of B3 shown in FIG. 21 and as a result, similar advantages can be obtained.

Further, similar advantages can be obtained if the movable member 144 for mechanically joining the diaphragm 143 and the photosensor 146 serving as the signal generation means is formed of a material having such a size as to be changed in the moving direction, i.e. contract in a low temperature state and expand in a high temperature state.

That is, in this case, in the low temperature state, the size in the moving direction of the upright part 144*b* of the movable member 144 contracts to substantially shift the tip of the movable member 144 away from the sensible area of the photosensor 146, so that the value of pressure when the photosensor 146 detects the move state of the moving member becomes high.

Therefore, driving the air pressurizing pump is continued, thereby increasing the flow velocity of ink with which the sub-tank is replenished from the main tank.

On the other hand, in the high temperature state, the size in the moving direction of the upright part 144*b* of the movable member 144 expands to substantially shift the tip of the movable member 144 toward the sensible area of the photosensor 146, so that the value of pressure when the photosensor 146 detects the move state of the moving member becomes low.

Therefore, driving the air pressurizing pump is stopped at an early stage, thereby decreasing the flow velocity of ink with which the sub-tank is replenished from the main tank. Thus, the ink replenishment flow velocity is shifted from the range of A3 to the range of B3 shown in FIG. 21 and as a result, similar advantages can be obtained.

If any one of the above-described means is used solely or the means are used in combination, it is desirable that the temperature dependency characteristic of the value of pressure to generate the pressure sense signal by the pressure detector should be almost equal to the temperature dependency characteristic in the viscosity of ink with which the sub-tank is replenished from the main tank.

It is also desirable that the temperature dependency characteristic of the value of pressure to generate the pressure sense signal by the pressure detector should be almost equal to the temperature dependency characteristic of the pressure loss on the replenishment passage of ink with which the sub-tank is replenished from the main tank.

Consequently, the change amount of the flow velocity of the ink with which the sub-tank is replenished from the main tank can be maintained in a predetermined range even if the environmental temperature is changed.

As can be seen from the forgoing description, an ink jet recording apparatus constructed according to the sixth embodiment of the invention utilizes a pressure detector having a signal generation system for generating a pressure sense signal based on displacement amount of a diaphragm, and a diaphragm or a component between the diaphragm and the signal generation system is formed using a material having a temperature dependency characteristic. Accordingly, the flow velocity of ink with which the sub-tank is replenished from the main tank can be maintained in a predetermined range even if the environmental temperature is changed.

Moreover, the above-described function can be obtained with a comparatively simple construction using the diaphragm, and thus can be realized at comparatively low costs.

What is claimed is:

1. An ink jet recording apparatus comprising a record head mounted on a carriage and reciprocated in a width direction of record paper, and a sub-tank mounted on the carriage together with the record head for receiving replenishment with ink via an ink replenishment passage from a main tank, and supplying ink to the record head, wherein air pressure generated by an air pressurizing pump is applied to the main tank, and the sub-tank is replenished with ink from the main tank by the action of the air pressure, the recording apparatus further comprising:

an on-off valve unit having a valve member provided to an air flow passage from the air pressurizing pump to the main tank and opened under a given or more air pressure for maintaining the air pressure in the air flow passage within a predetermined range; and a drive system capable of forcibly opening the valve member in the on-off valve unit, thereby releasing a pressurization state of the air pressurizing pump.

2. An ink jet recording apparatus, wherein pressurized air generated by an air pressurizing pump is applied to a main tank storing ink and a record head mounted on a carriage is replenished with ink from the main tank by the action of the pressurized air, the recording apparatus comprising:

a pressure detector, provided to an air flow passage between the air pressurizing pump and the main tank, for detecting pressure of the pressurized air, wherein driving of the air pressurizing pump is controlled based on a control signal generated according to the pressure detected by the pressure detector, the pressure detector including:

a diaphragm displaced upon reception of the air pressure of the pressurized air; and an output generation system for generating a control signal based on the displacement amount of the diaphragm.

3. The ink jet recording apparatus as claimed in claim 2, wherein the main tank has a hermetic outer shell storing an ink pack formed of a flexible material in which ink is sealingly accommodated, and wherein the pressurized air generated by the air pressurizing pump is applied to a pressure chamber formed between an outer shell component of the main tank and the ink pack.

4. The ink jet recording apparatus as claimed in claim 2, wherein a sub-tank mounted on the carriage is replenished with ink via an ink replenishment passage from the main tank, and ink is supplied from the sub-tank to the record head mounted on the carriage.

5. The ink jet recording apparatus as claimed in claim 4, wherein the ink replenishment passage from the main tank to the sub-tank includes a flexible ink replenishment tube.

6. The ink jet recording apparatus as claimed in claim 2, wherein the output generation system includes a movable member which advances or retreats by the displacement of the diaphragm, and a photosensor having a light source and a light receiving element disposed to cross a move path of the movable member and generating the control signal based on output of the light receiving element forming a part of the photosensor.

7. The ink jet recording apparatus as claimed in claim 2, wherein the output generation system includes a movable member which advances or retreats by displacement of the diaphragm, and a photosensor having a light source for projecting light onto a move path of the movable member and a light receiving element for receiving reflected light of the light source based on a movement of the movable member and generating the control signal based on output of the light receiving element forming a part of the photosensor.

8. The ink jet recording apparatus as claimed in claim 6 or 7, wherein the diaphragm is formed of an elastic material and the movable member advances or retreats based on displacement of the diaphragm depending on balance of the air pressure received by the diaphragm and the restoration force of the diaphragm.

9. The ink jet recording apparatus as claimed in claim 8, wherein the movable member is formed with a step part for preventing the diaphragm from being excessively displaced by the air pressure.

10. The ink jet recording apparatus as claimed in claim 6 or 7, further comprising a spring member for urging the diaphragm in a restoration direction of the diaphragm, wherein the movable member advances or retreats based on the displacement of the diaphragm depending on balance of the air pressure received by the diaphragm, the restoration force of the diaphragm, and the urging force of the spring member.

11. The ink jet recording apparatus as claimed in claim 10, further comprising a stopper member for receiving the urging force of the spring member and inhibiting excessive displacement of the diaphragm.

12. The ink jet recording apparatus as claimed in claim 6 or 7, wherein the movable member is molded integrally with the diaphragm.

13. The ink jet recording apparatus as claimed in claim 2, wherein the diaphragm is formed of rubber.

14. The ink jet recording apparatus as claimed in claim 2, wherein the diaphragm is formed of rubber and cloth.

15. The ink jet recording apparatus as claimed in claim 2, wherein the diaphragm is arranged to close an opening part of a case, and a space portion for receiving the air pressure from the air pressurizing pump is formed in the case.

16. The ink jet recording apparatus as claimed in claim 15, wherein the case is formed with a pressurized air introduction connection tube for introducing the pressurized air from the air pressurizing pump into the space portion, and a plurality of pressurized air distribution connection tubes for distributing the pressurized air to respective main tank from the space portion.

17. An ink jet recording apparatus, wherein pressurized air generated by an air pressurizing pump is applied to a main tank storing ink, and ink is supplied from the main tank to a record head mounted on a carriage by the action of the pressurized air, the recording apparatus comprising:

a pressure detector, provided to an air flow passage between the air pressurizing pump and the main tank, for detecting pressure of the pressurized air; and a control system for driving the air pressurizing pump if a pressure detection value obtained by the pressure detector does not reach a predetermined pressure value, and stopping the air pressurizing pump after expiration of a predetermined time if the pressure detection value obtained by the pressure detector reaches the predetermined pressure value.

* * * * *